US012428831B2

(12) United States Patent
Pearson et al.

(10) Patent No.: US 12,428,831 B2
(45) Date of Patent: Sep. 30, 2025

(54) STRUCTURAL MEMBER ASSEMBLIES, BEAMS, AND SUPPORT STRUCTURES COMPRISING SAME

(71) Applicant: ELEVATE STRUCTURES, LLC, Villa Rica, GA (US)

(72) Inventors: Christopher Bruce Pearson, Villa Rica, GA (US); Heath Jackson Mulkey, Villa Rica, GA (US)

(73) Assignee: Elevate Structures, LLC, Villa Rica, GA (US)

( * ) Notice: Subject to any disclaimer, the term of this patent is extended or adjusted under 35 U.S.C. 154(b) by 0 days.

(21) Appl. No.: 18/397,294

(22) Filed: Dec. 27, 2023

(65) Prior Publication Data

US 2024/0167266 A1 May 23, 2024

Related U.S. Application Data

(60) Continuation of application No. 17/589,187, filed on Jan. 31, 2022, now Pat. No. 11,859,377, which is a continuation of application No. 16/802,050, filed on Feb. 26, 2020, now Pat. No. 11,248,373, which is a division of application No. 16/443,493, filed on Jun. 17, 2019, now Pat. No. 10,597,864, which is a continuation-in-part of application No. 16/400,896, filed on May 1, 2019, now Pat. No. 10,513,849.

(51) Int. Cl.

| | |
|---|---|
| ***E04C 3/00*** | (2006.01) |
| ***E04B 1/30*** | (2006.01) |
| ***E04C 3/293*** | (2006.01) |

(52) U.S. Cl.
CPC ..... *E04B 1/30* (2013.01); *E04C 3/293* (2013.01)

(58) Field of Classification Search
CPC ..... E04B 1/30; E04C 3/293
See application file for complete search history.

(56) References Cited

U.S. PATENT DOCUMENTS 947,514 A * 1/1910 Stevens ..... E04C 3/293 52/480
1,007,556 A * 10/1911 Graham ..... E04C 3/293 52/334
1,013,591 A * 1/1912 Edwards, Jr. ..... E04C 3/293 52/422

(Continued)

*Primary Examiner* — Basil S Katcheves
(74) *Attorney, Agent, or Firm* — Ballard Spahr LLP

(57) ABSTRACT

A beam can comprise a plurality of steel channel members that extend along a longitudinal axis. The plurality of steel channel members can cooperate to define an interior volume that is configured to receive concrete therein. The plurality of steel channel members can comprise a first C-shaped channel member defining a channel therein and having first and second flanges. The channel of the first C-shaped channel member can define a portion of an outer boundary of the interior volume. The first and second flanges can extend into the interior volume. A plurality of internally projecting members can be spaced along the longitudinal axis. The plurality of internally projecting members can extend into the interior volume from a steel channel member of the plurality of steel channel members. A strap can extend across the interior volume so that when the interior volume is filled with concrete, the strap engages the concrete.

19 Claims, 21 Drawing Sheets

(56) References Cited

U.S. PATENT DOCUMENTS 2,049,926 A * 8/1936 Rafter ..... E04C 3/293 52/837
2,104,506 A * 1/1938 Coddington ..... E04C 3/293 52/834
2,112,480 A * 3/1938 Coddington ..... E04C 3/293 52/694
3,200,732 A * 8/1965 Chantiles ..... B60H 1/3407 220/361
3,704,679 A * 12/1972 Haynes ..... B66C 1/0293 114/51
4,055,890 A * 11/1977 Seibold ..... A01G 3/067 30/240
4,196,558 A * 4/1980 Jungbluth ..... E04C 3/293 52/340
4,261,156 A * 4/1981 Fromont ..... E04B 1/215 52/834
4,347,019 A * 8/1982 Metz ..... E04C 3/293 405/257
4,409,764 A * 10/1983 Wilnau ..... E04B 1/165 52/204.2
4,584,811 A * 4/1986 Balinski ..... E04C 3/293 52/745.12
4,779,395 A * 10/1988 Schleich ..... E04C 3/293 52/837
4,872,721 A * 10/1989 Sniadach ..... B60J 3/02 248/205.5
4,905,440 A * 3/1990 Schilger ..... E04C 3/293 52/368
4,912,794 A * 4/1990 Thivans ..... E01D 2/02 14/4
5,050,358 A * 9/1991 Vladislavic ..... E04B 1/161 52/250
5,065,537 A * 11/1991 Bailey ..... G09F 7/12 40/621
5,107,650 A * 4/1992 Patrick ..... E04B 5/40 52/674
5,509,243 A * 4/1996 Bettigole ..... E04C 2/423 52/414
5,553,437 A * 9/1996 Navon ..... E04C 3/07 52/837
5,625,997 A * 5/1997 Callahan ..... E04B 2/766 52/847
5,803,653 A * 9/1998 Zuffetti ..... E04C 3/07 52/645
5,921,053 A * 7/1999 Callahan ..... E04C 3/07 52/843
6,058,666 A * 5/2000 Lin ..... E01D 2/02 52/223.8
6,058,673 A * 5/2000 Wycech ..... E06B 3/222 296/187.02
6,253,524 B1 * 7/2001 Hopton ..... B29C 44/18 52/843
6,295,770 B1 * 10/2001 Sheu ..... E04C 5/04 52/649.3
6,332,301 B1 * 12/2001 Goldzak ..... E04C 3/10 52/223.13
6,802,170 B2 * 10/2004 Davis ..... E04C 3/07 52/843
7,143,554 B2 * 12/2006 Sachs ..... E04C 3/20 52/251
8,141,307 B2 * 3/2012 Hillman ..... E04C 3/29 52/607
8,910,450 B2 * 12/2014 Simon-Dominguez ..... E04B 5/261 52/327
8,915,042 B2 * 12/2014 Ahn ..... E04B 5/43 52/649.6
10,513,849 B1 * 12/2019 Pearson ..... E04B 1/24
10,597,864 B1 * 3/2020 Pearson ..... E04B 5/40
12,123,191 B2 * 10/2024 Lee ..... E04C 3/07
12,139,905 B2 * 11/2024 Stephan ..... E04B 1/2403
2004/0093825 A1 * 5/2004 Lee ..... E04C 3/06 52/843
2004/0166955 A1 * 8/2004 Nadratowski ..... A63B 47/02 473/286
2006/0016078 A1 * 1/2006 Bladow ..... B21D 53/88 29/897.31
2007/0056245 A1 * 3/2007 Edmondson ..... E04B 1/24 52/848
2009/0249705 A1 * 10/2009 Struthers ..... H02G 1/00 33/290
2010/0163506 A1 * 7/2010 Clarke ..... A47B 47/027 211/183
2011/0271614 A1 * 11/2011 Brady ..... E06B 3/9642 52/745.15
2012/0060443 A1 * 3/2012 Vernon ..... E04C 3/07 72/46
2013/0283721 A1 * 10/2013 Ahn ..... E04B 1/24 52/649.6
2014/0165499 A1 * 6/2014 Vanker ..... E04C 3/07 29/897
2018/0002925 A1 * 1/2018 Kwon ..... E04C 3/205
2018/0195543 A1 * 7/2018 Lynn ..... H02S 20/00

* cited by examiner

STRUCTURAL MEMBER ASSEMBLIES, BEAMS, AND SUPPORT STRUCTURES COMPRISING SAME

CROSS-REFERENCE TO RELATED APPLICATION

This application is a continuation of U.S. patent application Ser. No. 17/589,187, filed Jan. 31, 2022, which is a continuation of U.S. patent application Ser. No. 16/802,050, filed Feb. 26, 2020, now U.S. Pat. No. 11,248,373, which is a division of U.S. patent application Ser. No. 16/443,493, filed on Jun. 17, 2019, now U.S. Pat. No. 10,597,864, which is a continuation-in-part of U.S. patent application Ser. No. 16/400,896, filed on May 1, 2019, now U.S. Pat. No. 10,513,849. Each of the above-identified applications is hereby incorporated herein by reference in its entirety.

FIELD

The disclosed invention relates to structural members, beams, and support structures. Optionally, the disclosed structural members, beams, and support structures can be used to construct at least a portion of a structural design, such as a building.

BACKGROUND

Structural members, such as beams, braces, tubes, rods, and columns, can be used as constituents of a structure's frame. The amount of material used in each structural member can reduce the cost of said structural member, but material reduction typically corresponds with a reduction in strength. Accordingly, a strong, inexpensive alternative can be desirable.

Structural members can be attached end-to-end to create columns and frames of structures. Accordingly, it can be desirable to facilitate alignment and coupling between adjacent structural members.

Conventional steel-concrete composite beams typically comprise heavy steel beams that can be expensive and increase weight without substantial added benefit to the beam's strength. Moreover, a lack of engagement between the steel and the concrete can limit the strength of the beam.

SUMMARY

Described herein, in various aspects, is a structural member design that can be used in a horizontal fashion to transfer building loads to vertical supports of a building or structure. The design of this horizontal structural member, referred to as a beam, can comprise a unique assembly of C-shaped channel members or "cees" assembled in a way to optimize strength and ease of constructability. The design can comprise shape-specific members that integrate the channel members and concrete into a strong and inexpensive composite beam.

According to a first aspect, a beam can have an upper surface and can comprise a plurality of steel channel members that extend along a longitudinal axis. The plurality of steel channel members can cooperate to define an interior volume that is configured to receive concrete therein. The plurality of steel channel members can comprise a first C-shaped channel member defining a channel therein and having a base wall, first and second side walls extending perpendicularly from the base wall, and first and second flanges respectively inwardly extending from the first and second side walls. The channel of the first C-shaped channel member can define a portion of the interior volume. The first and second flanges can extend into the interior volume. A plurality of internally projecting members can be spaced along the longitudinal axis. The plurality of internally projecting members can be coupled to the base wall of the first C-shaped channel member and extend into the interior volume. A strap can be secured to the upper surface of the beam and extend across the interior volume so that when the interior volume is filled with concrete, the strap engages the concrete.

The plurality of steel channel members can further comprise a second C-shaped channel member defining a channel therein and having an outer surface opposite the channel and a third C-shaped channel member defining a channel therein and having an outer surface opposite the channel, wherein the second and third C-channels are disposed so that their respective channels open away from each other. The first C-shaped channel can extend between the second and third C-shaped channels. The channel of the first C-shaped channel member and outer surfaces of the second C-shaped channel member and the third C-shaped channel member can cooperate to define at least a portion of the interior volume.

The plurality of inwardly projecting members can comprise a plurality of shoulder bolts that are bolted to at least one steel channel member of the plurality of steel channel members.

The beam can further comprise a generally planar wall that is elongated along the longitudinal axis and attached to the base wall of the first steel channel member. Each inwardly projecting member of the plurality of inwardly projecting members can comprise a web section extending upwardly from the generally planar wall, the web section having a distal end, and a generally planar tab extending perpendicularly to, and from the distal end of, the web section.

Each generally planar tab can have a distal end. Each inwardly projecting member of the plurality of inwardly projecting members can further comprise a flange extending generally perpendicularly to the distal end of the generally planar tab.

The internally projecting members can be spaced apart by between about 6 inches and about 12 inches.

The beam can further comprise a plurality of depending internally projecting components attached to, and extending downward from, the plurality of straps.

The depending internally projecting components can comprise a pair of parallel portions and a web extending vertically between the parallel portions.

At least one of the plurality of depending internally projecting components can extend down from a respective strap of the plurality of straps by at least 33% of a height of the beam.

Each of the plurality of steel channel members can comprise light gauge steel.

The plurality of internally projecting members can comprise a plurality of C-shaped components that are attached to the first C-shaped channel member.

The beam can further comprise concrete cured within the interior volume, wherein the first and second flanges of first C-shaped channel member, the plurality of internally projecting members, and the strap are engaged with the cured concrete.

A beam can comprise a plurality of steel channel members that extend along a longitudinal axis, wherein the plurality of steel channel members cooperate to define an interior volume that is configured to receive concrete therein, and a reinforcement member disposed within the interior volume and attached to a steel channel member of the plurality of steel channel members. The reinforcement member can comprise a generally planar wall extending along the longitudinal axis, a plurality of web sections extending upwardly from the generally planar wall, each web section having a respective distal end, and a plurality of generally planar tabs, each generally planar tab extending from the distal end of a respective web section of the plurality of web sections.

The reinforcement member can further comprise a plurality of flanges, each flange of the plurality of flanges extending generally perpendicularly to the distal end of a respective generally planar tab.

The adjacent web sections can be spaced apart by between about 6 inches and about 12 inches.

The beam can have an upper surface and further comprises a plurality of straps secured to the upper surface of the beam and extending across the interior volume.

The beam can further comprise a plurality of depending internally projecting components attached to, and extending downward from, the plurality of straps.

The depending internally projecting components can comprise a pair of parallel portions and a web extending vertically between the parallel portions.

At least one of the plurality of depending internally projecting components can extend down from a respective strap of the plurality of straps by at least 33% of a height of the beam.

Each of the plurality of steel channel members can comprise light gauge steel.

Additional advantages of the invention will be set forth in part in the description that follows, and in part will be obvious from the description, or may be learned by practice of the invention. The advantages of the invention will be realized and attained by means of the elements and combinations particularly pointed out in the appended claims. It is to be understood that both the foregoing general description and the following detailed description are exemplary and explanatory only and are not restrictive of the invention, as claimed.

DESCRIPTION OF THE DRAWINGS

These and other features of the preferred embodiments of the invention will become more apparent in the detailed description in which reference is made to the appended drawings wherein.

DETAILED DESCRIPTION

Figure 1:
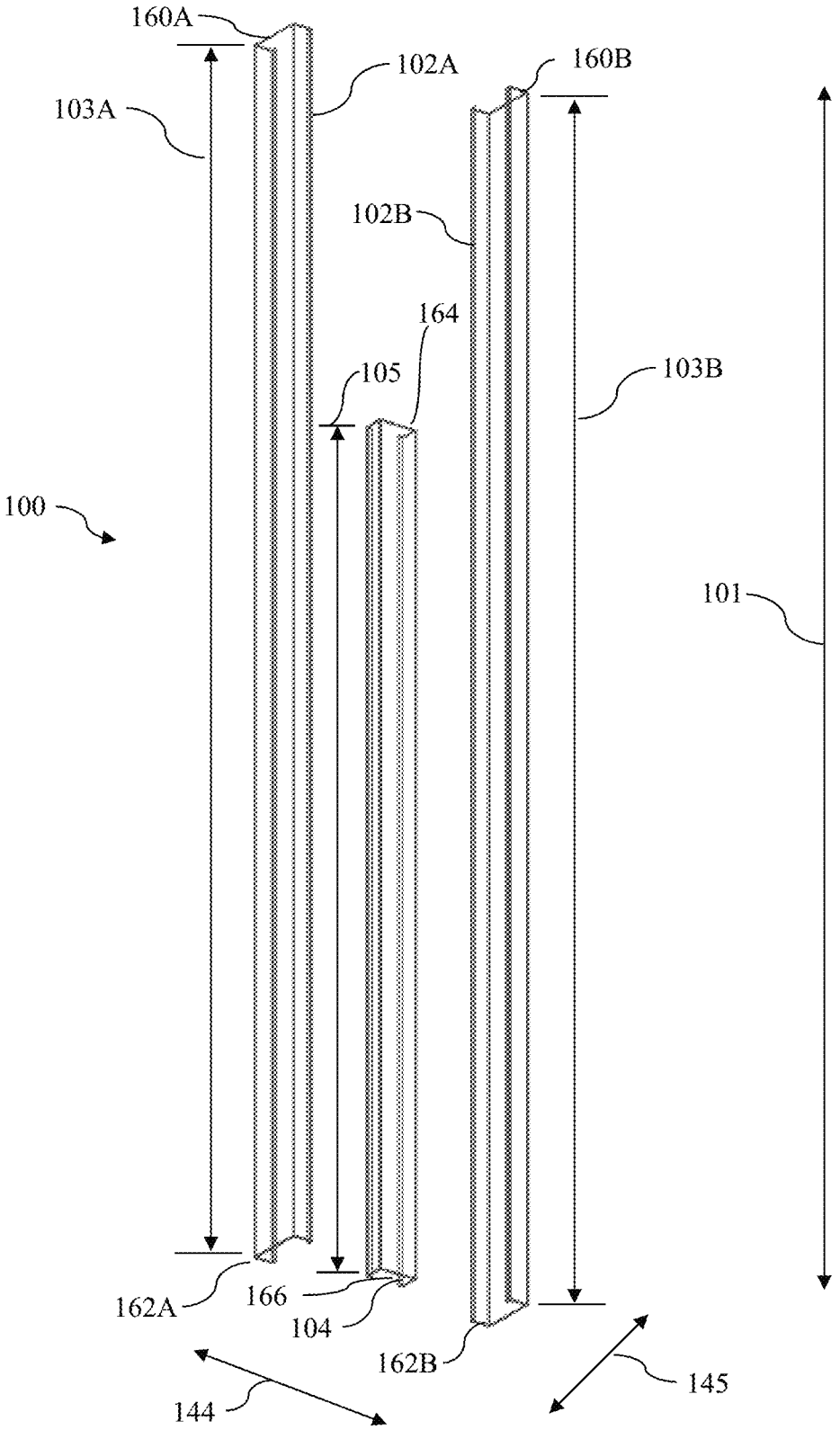
FIG. 1 is a perspective view of an exploded structural member assembly, in accordance with embodiments disclosed herein.

The present invention now will be described more fully hereinafter with reference to the accompanying drawings, in which some, but not all embodiments of the invention, are shown. Indeed, this invention may be embodied in many different forms and should not be construed as limited to the embodiments set forth herein; rather, these embodiments are provided so that this disclosure will satisfy applicable legal requirements. Like numbers refer to like elements throughout. It is to be understood that this invention is not limited to the particular methodology and protocols described, as such may vary. It is also to be understood that the terminology used herein is for the purpose of describing particular embodiments only, and is not intended to limit the scope of the present invention.

Many modifications and other embodiments of the invention set forth herein will come to mind to one skilled in the art to which the invention pertains having the benefit of the teachings presented in the foregoing description and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

As used herein the singular forms "a," "an," and "the" include plural referents unless the context clearly dictates otherwise. For example, use of the term "a flange" can refer to one or more of such flanges, and so forth.

All technical and scientific terms used herein have the same meaning as commonly understood to one of ordinary skill in the art to which this invention belongs unless clearly indicated otherwise.

As used herein, the terms "optional" or "optionally" mean that the subsequently described event or circumstance may or may not occur, and that the description includes instances where said event or circumstance occurs and instances where it does not.

As used herein, the term "at least one of" is intended to be synonymous with "one or more of" For example, "at least one of A, B and C" explicitly includes only A, only B, only C, and combinations of each.

The word "or" as used herein means any one member of a particular list and also includes any combination of members of that list.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint. Optionally, in some aspects, when values are approximated by use of the antecedent "about," it is contemplated that values within up to 15%, up to 10%, up to 5%, or up to 1% (above or below) of the particularly stated value can be included within the scope of those aspects. Similarly, when values are approximated by the use of the antecedent "approximately" "generally," or "substantially," it is contemplated that values within up to 15%, up to 10%, up to 5%, or up to 1% (above or below) of the particularly stated value can be included within the scope of those aspects.

It should be understood that references herein to "top," "bottom," "above", and "below" should be understood to be descriptive with respect to components' orientations as shown the Figures. Such references should not be understood to limit the orientations of the components to the embodiments shown. For example, the structural member assemblies can be inverted so that the "top" and "bottom" ends are reversed. Similarly, in various embodiments, the structural member assemblies and support columns can extend horizontally or at any other angle with respect to the ground.

It is to be understood that unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is in no way intended that an order be inferred, in any respect. This holds for any possible non-express basis for interpretation, including: matters of logic with respect to arrangement of steps or operational flow; plain meaning derived from grammatical organization or punctuation; and the number or type of aspects described in the specification.

The following description supplies specific details in order to provide a thorough understanding. Nevertheless, the skilled artisan would understand that the apparatus, system, and associated methods of using the apparatus can be implemented and used without employing these specific details. Indeed, the apparatus, system, and associated methods can be placed into practice by modifying the illustrated apparatus, system, and associated methods and can be used in conjunction with any other apparatus and techniques conventionally used in the industry.

Disclosed herein, in various aspects and with reference to FIG. 1, is a structural member assembly 100 (shown in an exploded view) that is elongated in a longitudinal dimension 101. The structural member assembly 100 can comprise a first outer channel member 102A having a length 103A, a second outer channel member 102B having a length 103B, and an inner member 104 having a length 105. The first and second outer channel members 102A, 102B and the inner member 104 can optionally comprise light gauge steel, such as, for example, 12*ga* through 20*ga*. Further, first and second outer channel members 102A, 102B and inner member 104 can optionally comprise hot formed steel. The first and second outer channel members 102A, 102B can each define a channel therein. The first and second outer channel members 102A, 102B can be positioned adjacent each other so that the respective channels cooperate to define an interior passage. The inner member 104 can be disposed at least partially within the interior passage and couple to each of the first outer channel member 102A and the second outer channel member 102B. Although members are shown in the Figures as coupling via fasteners, it should be understood that in further embodiments, other attachment methods, such as welding and strapping methods, may be used.

The following illustrated cross sections are not drawn to scale and are provided to generally describe cross sectional shapes. The cross sections can be described with reference to a first transverse dimension 144 and a second transverse dimension 145 that is perpendicular to the first transverse dimension.

First Embodiment of Outer Channel Members

Figure 2:
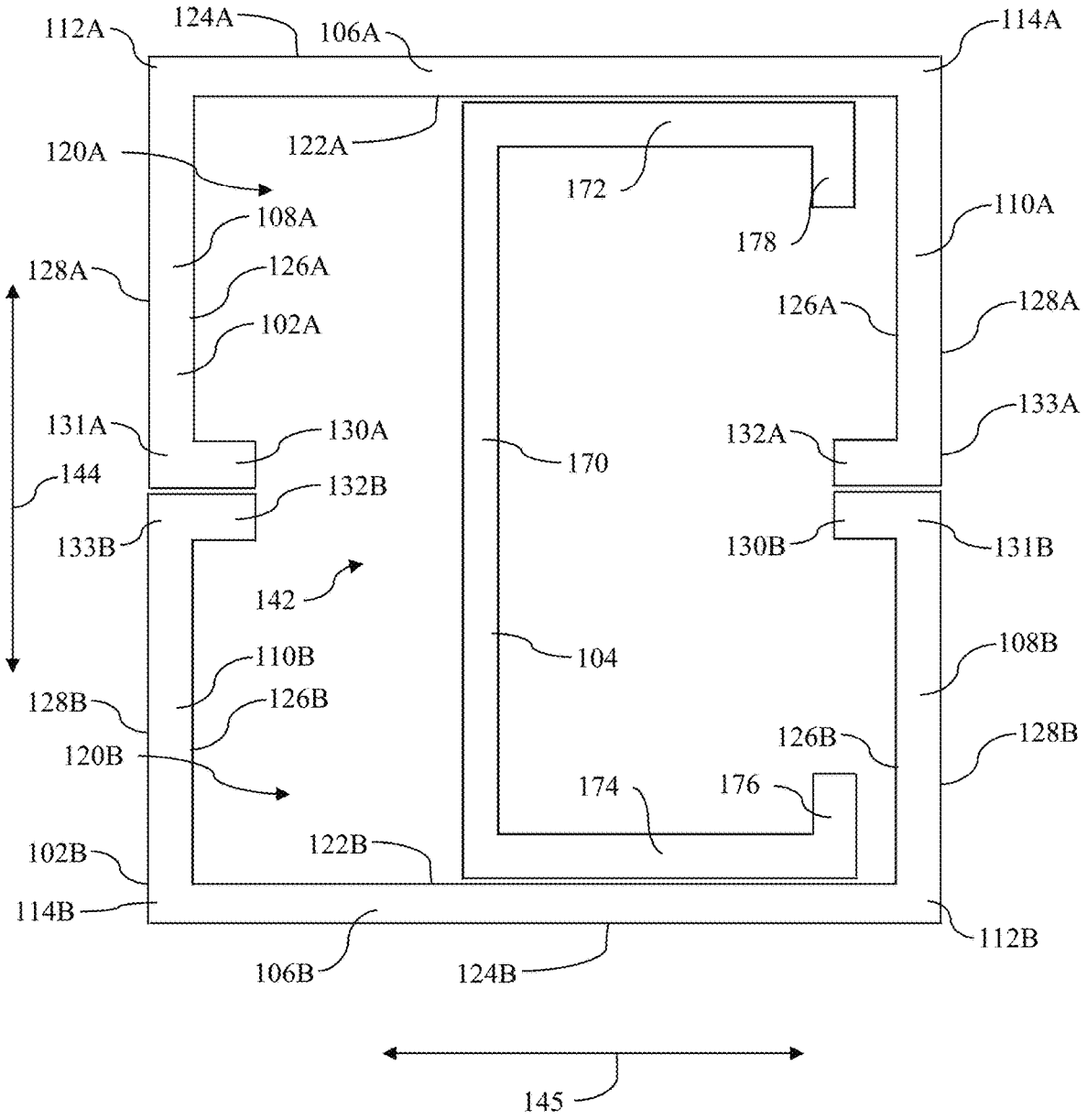
FIG. 2 is a cross section of the structural member assembly of FIG. 1.

Referring to FIG. 2, in a cross sectional plane perpendicular to the longitudinal dimension, each of the first and second outer channel members 102A, 102B can comprise a base wall 106A, 106B, a first side wall 108A, 108B, and a second side wall 110A, 110B. The first and second side walls can extend from respective first ends 112A, 112B and second ends 114A, 114B of respective base walls 106A, 106B. Optionally, the first and second side walls can extend perpendicularly or substantially perpendicularly to the respective base walls. Accordingly, each of the first and second channel members 102A, 102B can define a respective channel 120A, 120B. Each base wall 106A can have a respective inner surface, 122A, 122B and an opposing outer surface 124A, 124B. Similarly, each of the first and second side walls can define respective inner surfaces 126A, 126B and respective outer surfaces 128A, 128B. The respective inner surfaces of the base walls and side walls can cooperate to define the respective channels 120A, 120B. A respective first flange 130A, 130B can extend from an end 131A, 131B of each first side wall 108A, 108B opposite the respective base wall 106A, 106B and toward the respective second side wall 110A, 110B. Similarly, a respective second flange 132A, 132B can extend from an end 133A, 133B of each second side wall 110A, 110B opposite the respective base wall 106A, 106B and toward the respective first side wall 108A, 108B. The first flanges 130A, 130B and second flanges 132A, 132B can extend generally perpendicularly to their respective first and second side walls. Accordingly, in some embodiments, each of the first and second outer channel members 102A, 102B can have C-shaped profiles. In some embodiments, the length of the base wall 106A, 106B of the first and second outer members 102A, 102B can be between 2 inches to 12 inches, including, for example and without limitation, lengths of about 2 inches, about 3 inches, about 4 inches, about 5 inches, about 6 inches, about 7 inches, about 8 inches, about 9 inches, about 10 inches, about 11 inches, or about 12 inches. In some aspects, the length of the first and second side walls can optionally be half (or about half) of the length of the base wall. Accordingly, in these aspects, when the first and second outer members are coupled together in a structural member 100, the structural member 100 can have a square or substantially square cross sectional profile.

The first and second channels 102A, 102B can be disposed so that the inner surfaces of their respective base walls 106A, 106B oppose each other. The first channel 102A and the second channel 102B can be positioned so that their respective channels 120A, 120B cooperate to define an interior passage 142. According to at least one embodiment, as shown in FIG. 2, the ends 131A, 131B of respective first side walls 108A, 108B can abut corresponding ends 133A, 133B of respective second side walls 110A, 110B. In further embodiments, the ends 131A, 131B, 133A, 133B can be spaced from each other, either in the first transverse dimension, the second transverse dimension, or both, while still cooperating to define an interior passage 142. For example, in some embodiments, the first end 131A of the first channel member 102A and second end 133B of the second channel member 102B can be spaced from each other in the first transverse dimension 144 by a selected distance, such as about an inch.

Second Embodiment of Outer Channel Members

Figure 3:
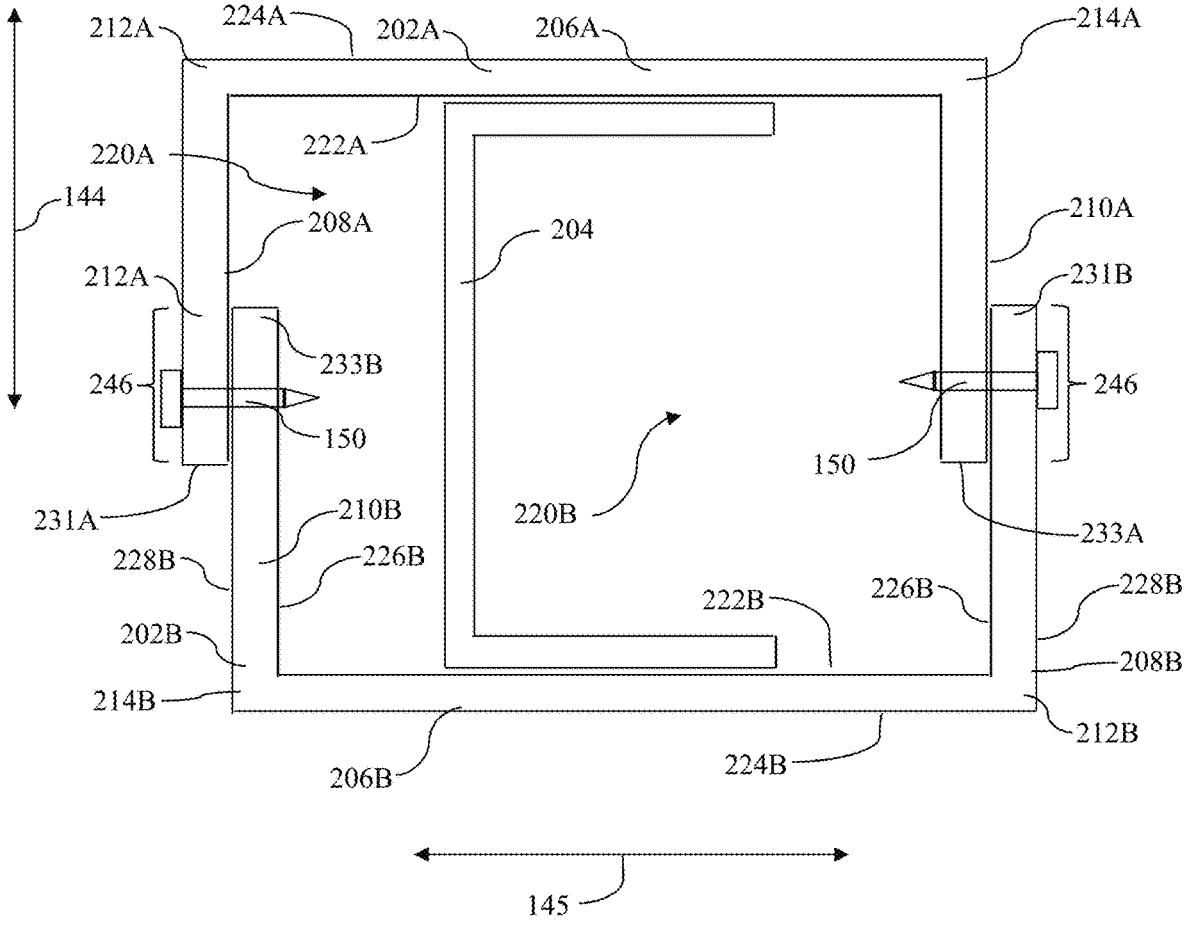
FIG. 3 is a cross section of an alternative structural member assembly, in accordance with embodiments disclosed herein.

Referring to FIG. 3, in a second embodiment, each of the first and second outer channel members can have U-shaped profiles (as opposed to the C-shaped profiles of FIG. 2 that include first and second flanges 130A,B, 132A,B). In a cross sectional plane perpendicular to the longitudinal dimension, each of the first and second outer channel members 202A, 202B can comprise a base wall 206A, 206B, a first side wall 208A, 208B and a second side wall 210A, 210B. The first and second side walls can extend from respective first ends 212A, 212B and second ends 214A, 214B of respective base walls 206A, 206B. Accordingly, each of the first and second channel members can define a respective channel 220A, 220B. Each base wall 206A can have a respective inner surface, 222A, 222B and an opposing outer surface 224A, 124B. Similarly, each of the first and second side walls can define respective inner walls 226A, 226B and respective outer walls 228A, 228B.

The first and second outer channel members 202A, 202B can be disposed so that the respective inner surfaces of the base walls and side walls can cooperate to define the respective channels 220A, 220B. The first side walls 208A, 208B can have ends 231A, 231B opposite the respective base wall 206A, 206B, and the second side walls 210A, 210B can have ends 233A, 233B opposite the respective base wall 206A, 206B. As shown in FIG. 3, ends 231A, 233A can extend past ends 231B, 233B in the first transverse dimension 144 so that the first arms 208A, 208B and second arms 210A, 210B can have overlapping portions 246. The overlapping portions 246 can optionally receive fasteners 150, such as, for example, self-tapping screws (e.g., TEX screws), rivets, or bolts, nuts, and washers. Optionally, the overlapping portions 246 can receive welds to affix the first and second outer channels together.

Structural Member Assemblies and Support Columns Formed from Same

Figure 4:
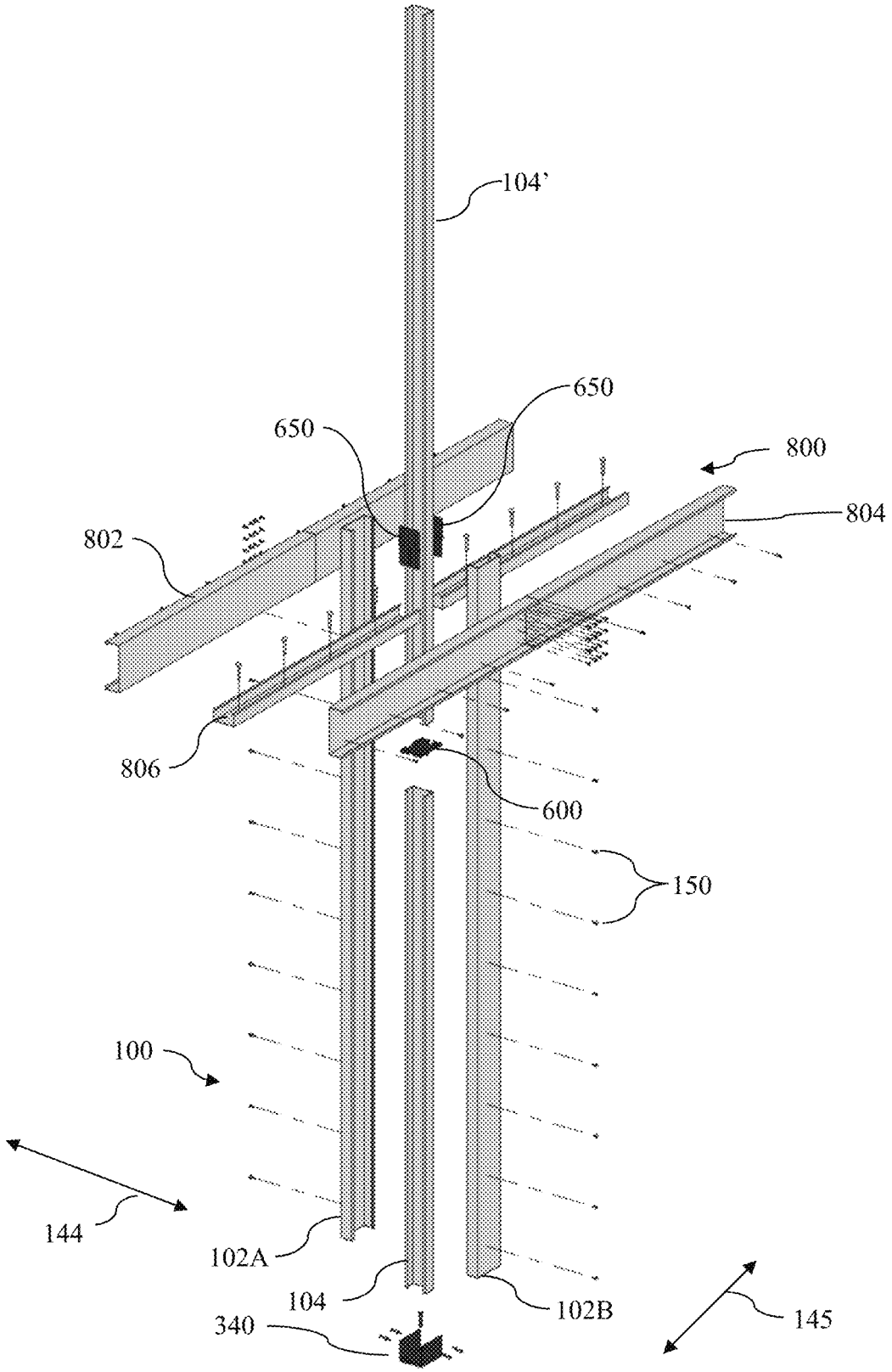
FIG. 4 is a perspective view of an exploded structural member assembly of FIG. 1 incorporated in a portion of a support column.

Referring to FIGS. 2-4, the inner member 104 can be received within, and extend through at least a portion of, the interior passage 142. In some embodiments, the inner member 104 can have the same profile as that of the first and second members. For example, as shown in FIG. 2, the inner member 104 can have a base wall 170, a first side wall 172 and a second side wall 174 extending from opposite ends of the base wall, and first and second flanges 176, 178 extending toward each other from distal ends of the first and second side walls. The first side wall 172 can abut the base wall 106A of the first outer channel member 102A, and the second side wall 174 can abut the base wall 106B of the second outer channel member 102B. Accordingly, the inner member 104 can extend between the base wall 106A of the first channel member 102A and the base wall 106B of the second channel member 102B. A plurality of fasteners 150 can attach the inner member 104 to each of the first and second channel members 102A, 102B along their shared length in the longitudinal dimension 101.

Although the inner member is shown as a channel having a C-shaped profile or a U-shaped profile in the Figures, it should be understood that the inner member can have various other profiles, such as, for example, that of an I-beam, Z-channel, track, threaded rod with mounting plates, cold formed tube steel, or hollow structural tube. Accordingly, although references herein are made specifically to the inner member 104, it should be understood that a U-shaped inner channel member 204, as shown in FIG. 3, or various other inner members having alternative profiles, can be used. Moreover, although for clarity and conciseness, embodiments disclosed herein refer to the reference numerals of the first embodiment of FIG. 2, it should be understood that various further embodiments consistent with the present disclosure can use members shown in the second embodiment of FIG. 3, as well as various other member profiles.

Referring to FIG. 1, the first outer channel member 102A can have a first longitudinal end 160A and a second longitudinal end 162A, and the second outer channel member 102B can have a first longitudinal end 160B and a second longitudinal end 162B. The inner member 104 can have a first longitudinal end 164 and a second longitudinal end 166. At least one of the longitudinal ends of the inner member 104 can be offset from a respective longitudinal end of the first outer channel member 102A and the second outer channel member 102B. That is, in one embodiment, the first longitudinal end 164 of the inner member 104 can be offset from the first longitudinal ends 160A, 160B of the first and second outer channel members 102A, 102B. In a further embodiment, the second longitudinal end 166 of the inner member 104 can be offset from the second longitudinal ends 162A, 162B of the first and second outer channel members 102A, 102B. Optionally, both longitudinal ends of the inner member can be offset from the respective longitudinal ends of the first and second outer channel members. In various embodiments, a longitudinal end of the inner member 104 can be offset from the respective longitudinal ends (the end of each member on the same side in the longitudinal dimension 101) of the first outer channel member 102A and the second outer channel member 102B by at least 12 inches. In further embodiments, at least one longitudinal end of the inner member 104 can be offset from the respective longitudinal ends of the first and second outer channel members optionally by at least one inch, at least six inches, at least twelve inches, at least two feet, or by at least three feet. In still further embodiments, the at least one longitudinal end of the inner member 104 can be offset from the respective longitudinal ends of the first and second outer channel members by approximately one third of the length of the first outer channel member. More generally, it is contemplated that the at least one longitudinal end of the inner member 104 can be offset from the respective longitudinal ends of the first and second outer channel members by approximately one-fourth to approximately one-half of the length of the first outer channel member.

Offsetting the end(s) can be accomplished, in some embodiments, by providing an inner member having a length that is greater than or less than the lengths of the first and second outer channel members 102A, 102B. In some embodiments, the inner member 104 can have a length 105 that is greater than half of the length 103A of the first outer channel member 102A and the length 103B of the second outer channel member 102B. The length 103A of the first outer channel member 102A can preferably be equal to the length 103B of the second outer channel member 102B, and respective longitudinal ends of the first and second outer channel members 102A, 102B can preferably be aligned. (It should be understood that respective ends of a member in relation to another member of the same structural member assembly can refer to ends on the same longitudinal end of each channel member. For example, the first end 160A of the first outer channel member 102A and the first end 160B of the second outer channel member 102B can be the "respective" ends with respect to the first end 164 of the inner member 104.) However, in optional embodiments, the length 103A of the first outer channel member 102A can be greater than or less than the length 103B of the second outer channel member 102B.

In providing at least one offset between at least one longitudinal end of the inner member and the respective longitudinal ends of the outer channel members, portions of adjacent structural member assemblies 100 can be nested, as disclosed herein. In this way, the plurality of structural member assemblies 100 can easily and efficiently be stacked end-to-end. For example, referring to FIGS. 1 and 4-6D, the first outer channel member 102A and second outer channel member 102B can each attach to the inner member 104 via fasteners 150 to construct a first structural member assembly. The bottom (second) longitudinal end 166 of the inner member 104 can be aligned with the bottom (second) ends 162A, 162B of the first and second outer channel members 102A, 102B. The first structural member assembly 100 can be anchored to a foundation via a bracket 340. The bracket 340 can receive a fastener 342 to secure the bracket 340 to a foundation. The first structural member assembly 100 can then be secured via fasteners 150 (or welded) to the bracket 340. For the first structural member assembly 100, the length 105 of the inner member 104 can be about three quarters of the length 103A of the first outer channel member 102A, the latter of which is equal to the length 103B of the second outer channel member 102B. Accordingly, as shown in FIG. 6A, the first structural member assembly 100 can define an empty portion 322 that comprises a length of the interior passage 142 that extends beyond the inner member 104. As shown in FIG. 6B, the empty portion 322 of the first structural member assembly's interior passage 142 can receive a portion of an inner member 104' of a second structural member assembly 100' therein. The inner member 104' can be secured to the first and second outer channel members 102A, 102B via a plurality of fasteners 150 along their respective shared lengths. In this way, the inner member 104 and the inner member 104' can cooperate to define an inner member assembly 750 that extends through, and structurally supports, an entire length of the first and second members 102A, 102B. That is, it is contemplated that two or more inner members, when arranged end-to-end, can collectively define a length that extends through an entire length of an interior passage defined by a first outer channel member and a second outer channel member. A protruding portion 324 of the inner member 104' can extend above the first and second outer channel members 102A, 102B, which can provide attachment surfaces for affixing first and second outer channel members 102A', 102B' of the second structural member assembly 100'. The first and second outer channel members 102A', 102B', once affixed via fasteners to the second inner member 104', can cooperate to define an empty portion 322' of their interior passage that can, in turn, receive a third inner member 104" of a third structural member assembly 100", as shown in FIG. 6C. The first and second outer channel members 102A', 102B' can attach to the third inner member 104" via fasteners. Referring to FIG. 6D, first and second outer channel members 102A", 102B" of a structural member 100" can be affixed to the portion of the third inner member 104" that extends from the first and second outer channel members 102A', 102B'. Accordingly, the structural member assemblies 100 can be stacked to create a support column 300.

Although the steps disclosed herein refer to empty portions of interior passages receiving inner members, it should be understood that, in embodiments consistent with this disclosure, adjacent pairs of inner members can be positioned end-to-end, and the outer channel members can then be positioned around the adjacent pair of inner members and coupled via fasteners to the pair of inner members. Accordingly, stacking of structural member assemblies 100, as disclosed herein, should be understood to describe the arrangement of the coupled structure, rather than the order in which the components are coupled. As disclosed herein, "respective longitudinal ends" of adjacent structures/members should be understood to include opposing ends of adjacent structures/members. For example, referring to FIG. 6D, with respect to the first structural member 100 and the second structural member 100, the top ends of the first and second outer channel members 102A, 102B and the bottom ends of the first and second outer channel members 102A', 102B' are "respective longitudinal ends" of adjacent structures/members.

The method of alternatingly attaching outer channel members of one structural member assembly to inner channel members of adjacent structural member assemblies can be repeated to create support columns of various lengths. In some embodiments, support columns 300 may comprise, two, three, four, five, or more structural member assemblies 100. Because the inner members are shorter than the outer channel members, an additional inner member 310 can extend through an empty portion 322" of an interior passage 142" of the structural member assembly 100" so that the collective length 312 of the inner members 104, 104", 104''' and the additional inner member 310 is substantially equal to the collective length 316 of the stacked outer channel members. According to some aspects, the ends of structural member assemblies 100 can directly abut respective adjacent structural member assemblies. However, it should be understood that this disclosure include support columns having some longitudinal spacing (e.g., less than one inch, less than two inches, or less than four inches) between adjacent structural member assemblies, or between components of adjacent structural member assemblies. Moreover, it should be understood that structural member assembly components that are separated by spacing components (e.g., spaced by the thickness of the coupling plates 650 or the thickness of the alignment plate 600) should fall within aspects of this disclosure. For example, it should be understood that adjacent ends of adjacent center members 140 that "extend to" each other can include ends of adjacent center members that engage the same alignment plate 600. Moreover, it is contemplated that center members that are spaced from adjacent center members can optionally "extend to" each other if they are longitudinally spaced by no more than one inch, by no more than two inches, or by no more than four inches. Similarly, members that are aligned "end-to-end" should be understood to include members that are abutting each other, spaced by a spacing component such as a coupling plate 650 or an alignment plate 600, or longitudinally spaced by no more than one inch, by no more than two inches, or by no more than four inches.

Figure 7:
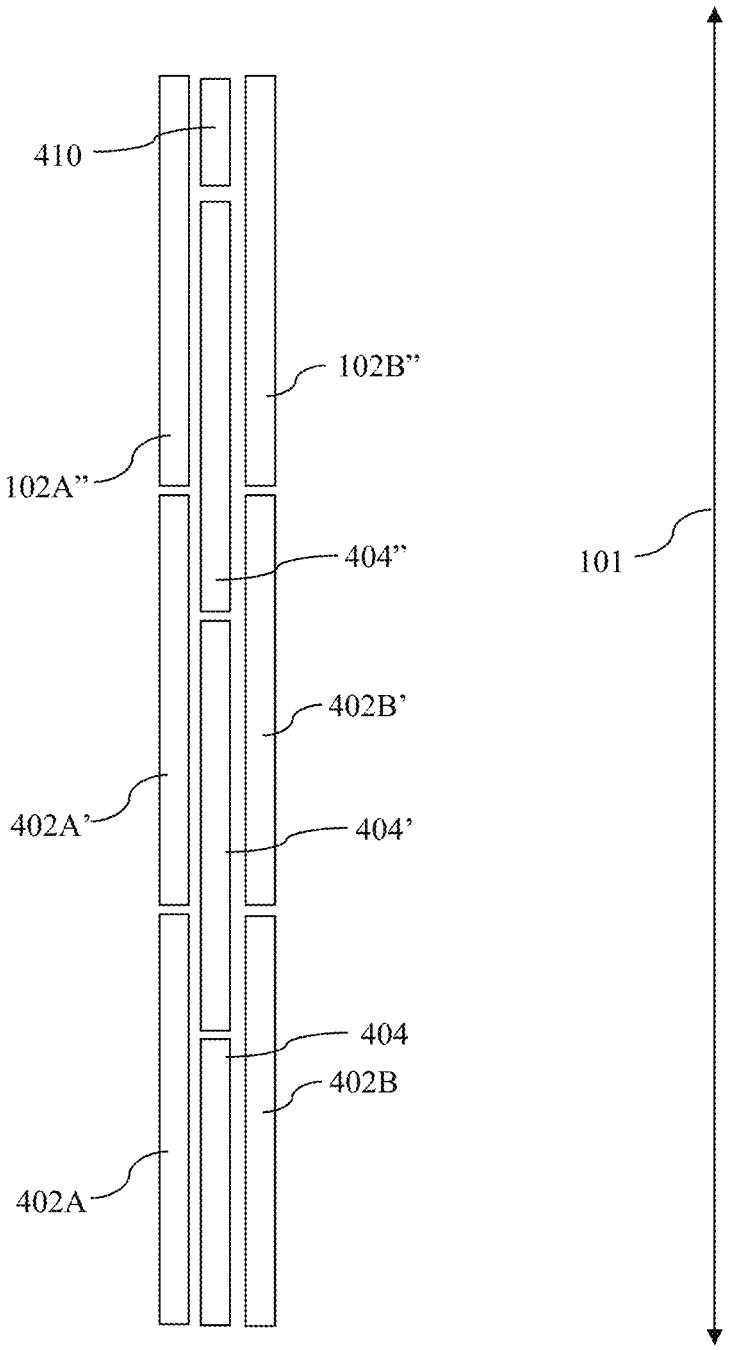
FIG. 7 is a schematic of another support column.

It should be understood that each inner member need not have the same length as the other inner members in a support column. For example, referring to FIG. 7, in some embodiments, a first inner member 404 can be shorter than its respective first and second outer channel members 402A, 402B. Each subsequent inner member 404', 404" can have the same length as their respective first and second outer channel members 402A', 402B', 402A", 402B". Because the first inner member 404 is shorter than its respective first and second outer channel members 402A, 402B, the other inner members 404', 404" can be shifted along the longitudinal dimension 101 with respect to their corresponding first and second outer channel members so that the respective longitudinal ends can be offset. An additional inner member 410, which can optionally have a shorter length than inner members 404', 404", can extend through the remainder of the length of the top structural member assembly's interior passage. As shown, in some optional aspects, it is contemplated that the combined length of the inner members can be equal or substantially equal to the combined length of the outer channel members.

Figure 8:
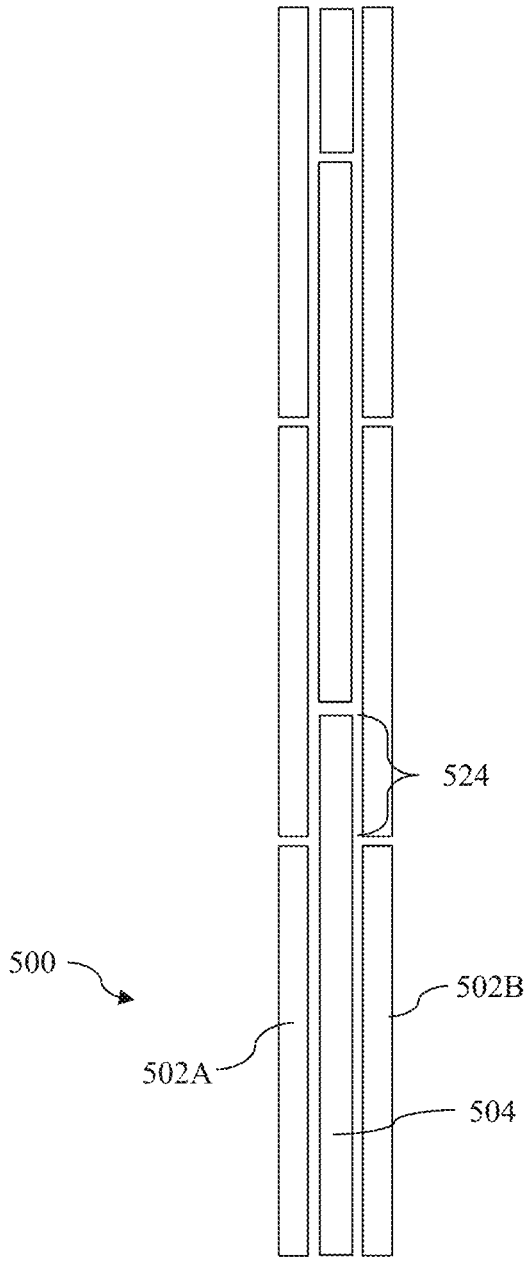
FIG. 8 is a schematic of yet another support column.
Figure 9:
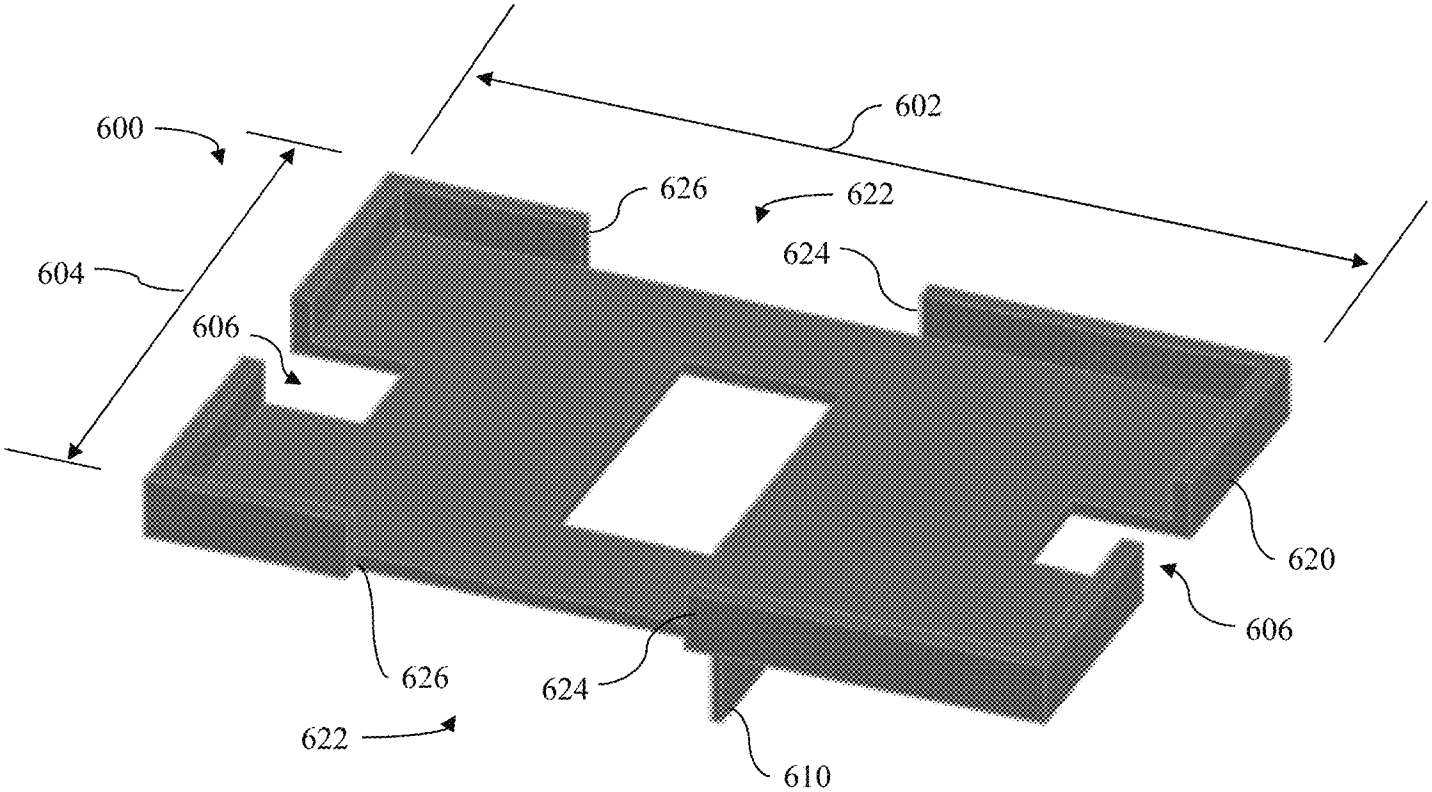
FIG. 9 is a top perspective view of an alignment bracket for use with embodiments of structural member assemblies as disclosed herein.
Figure 10:
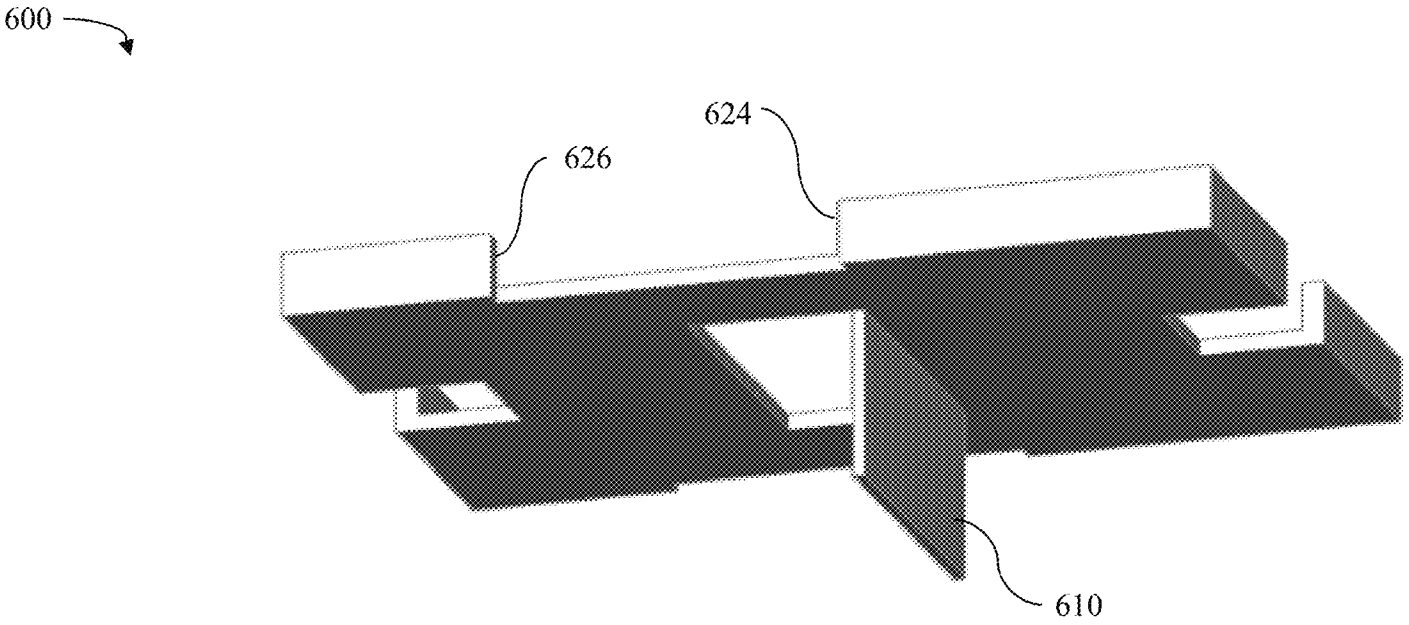
FIG. 10 is a bottom perspective view of the alignment bracket of FIG. 9.
Figure 11:
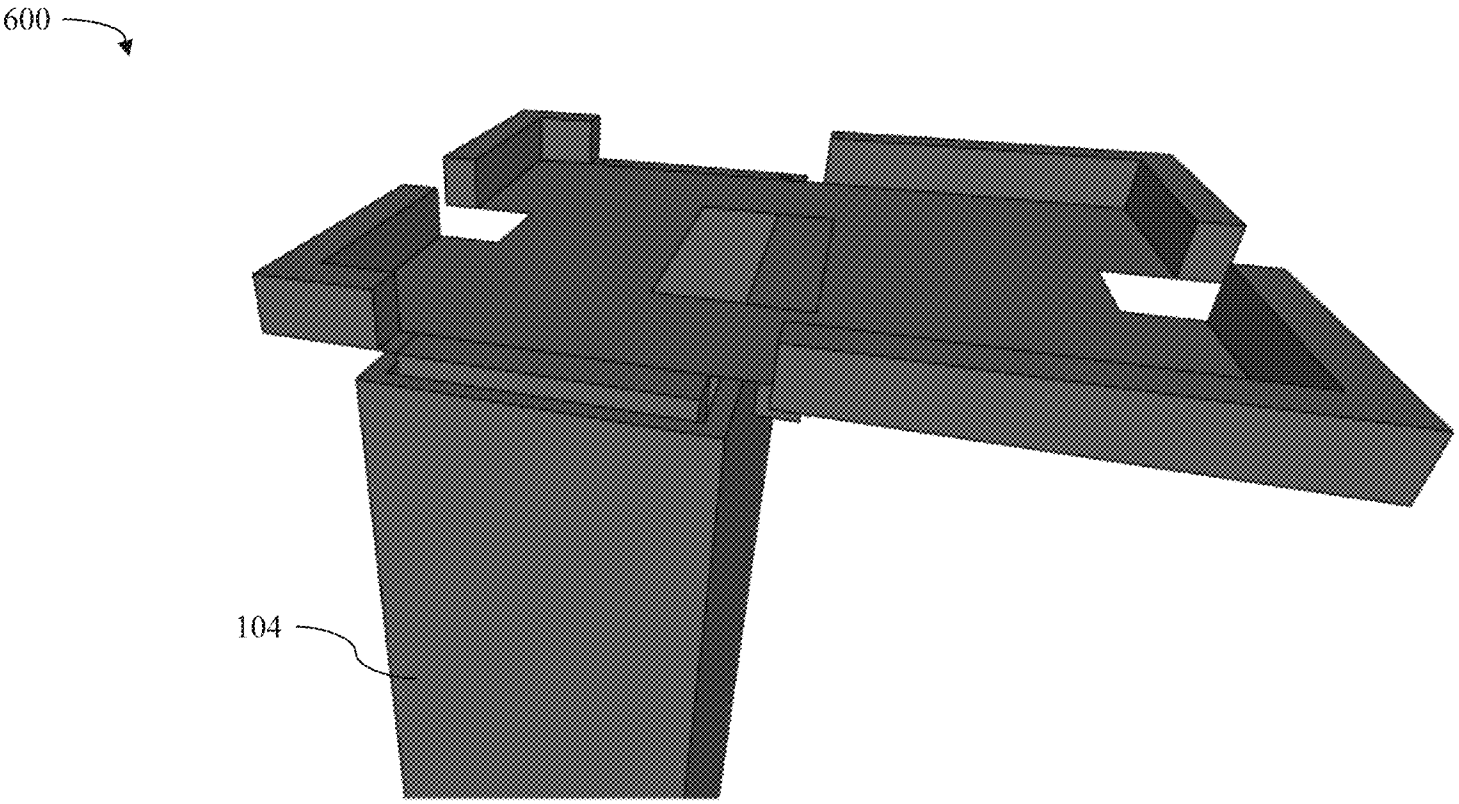
FIG. 11 is a perspective view of the alignment bracket of FIG. 9 coupled to an inner member of a structural member assembly, in accordance with embodiments disclosed herein.

In further embodiments, at least one inner member can be longer than its respective first and second outer channel members. For example, referring to FIG. 8, an inner member 504 of a structural member assembly 500 can be longer than its respective first and second outer channel members 502A, 502B, thereby providing a protruding portion 524 that extends beyond the respective ends of the first and second outer channel members 502A, 502B.

Figure 5:
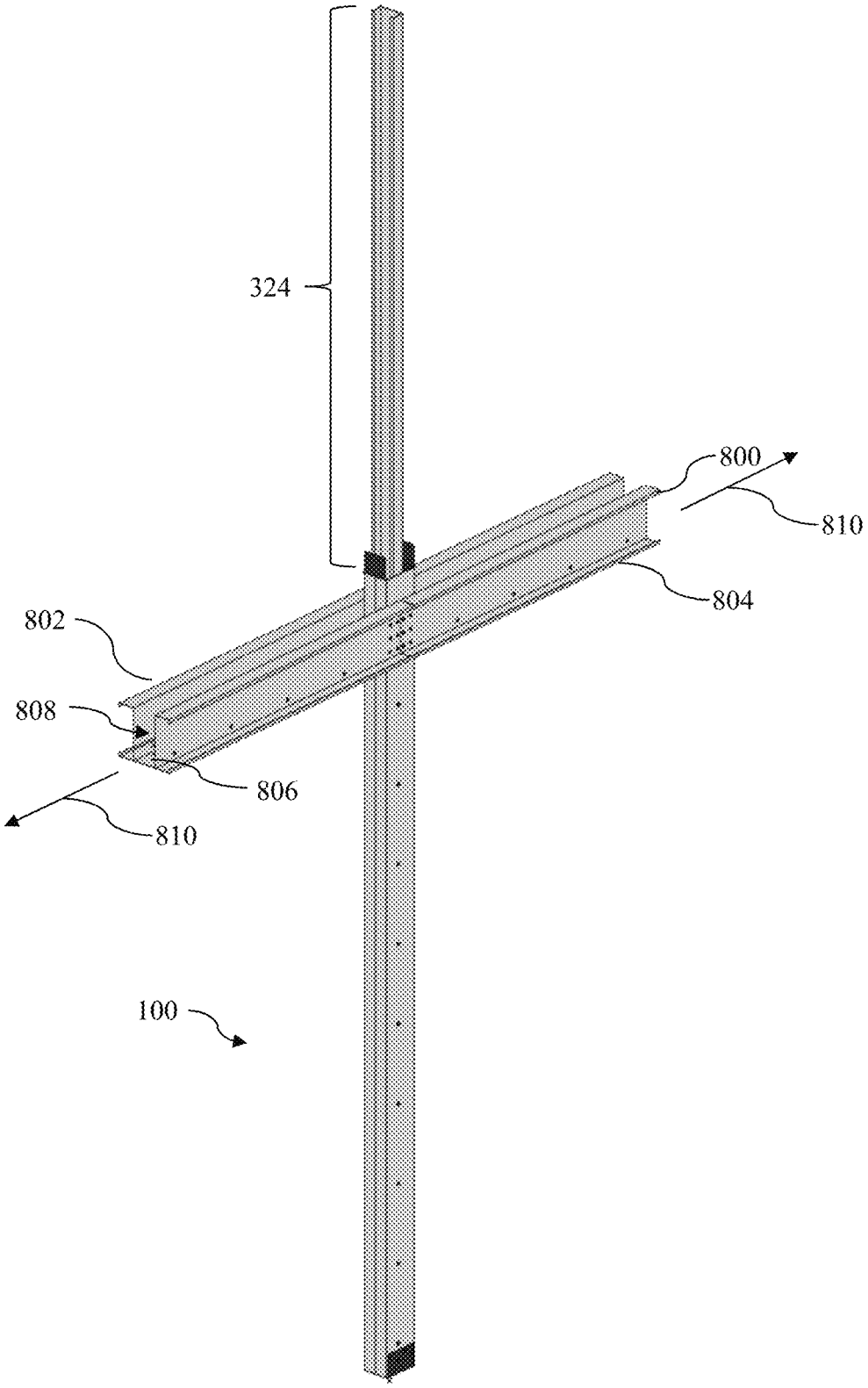
FIG. 5 is a perspective view of the portion of the support column of FIG. 4.
Figure 6A:
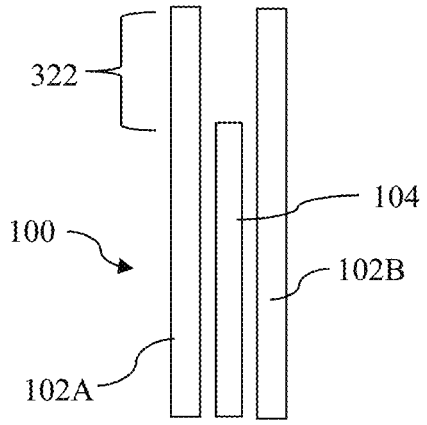
FIGS. 6A-6D are schematics of sequential assembly steps for constructing a support column.
Figure 6B:
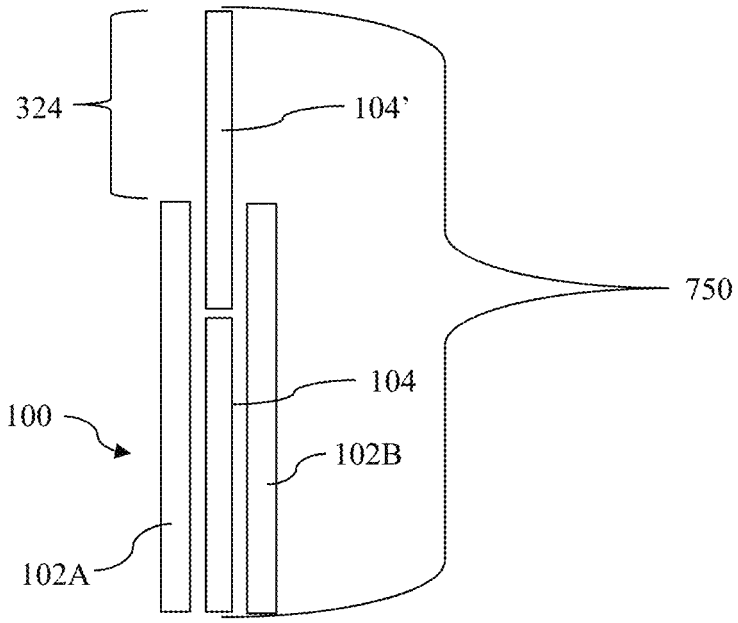
Figure 6C:
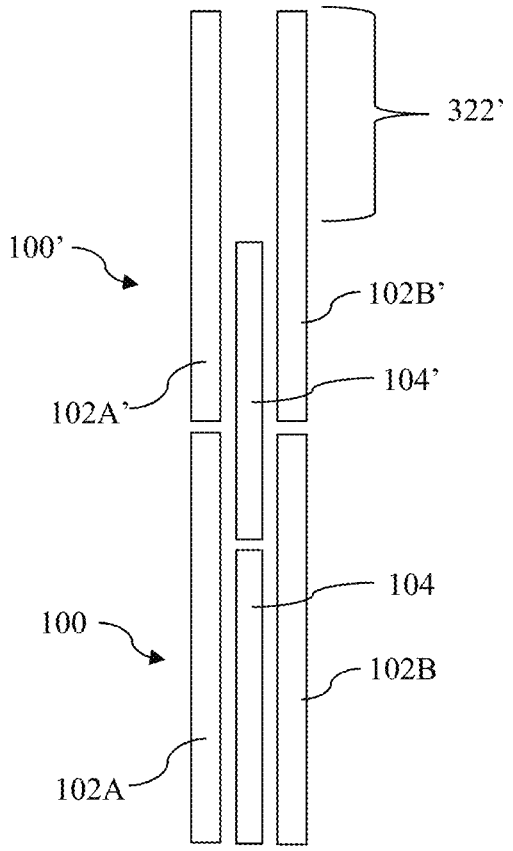
Figure 6D:
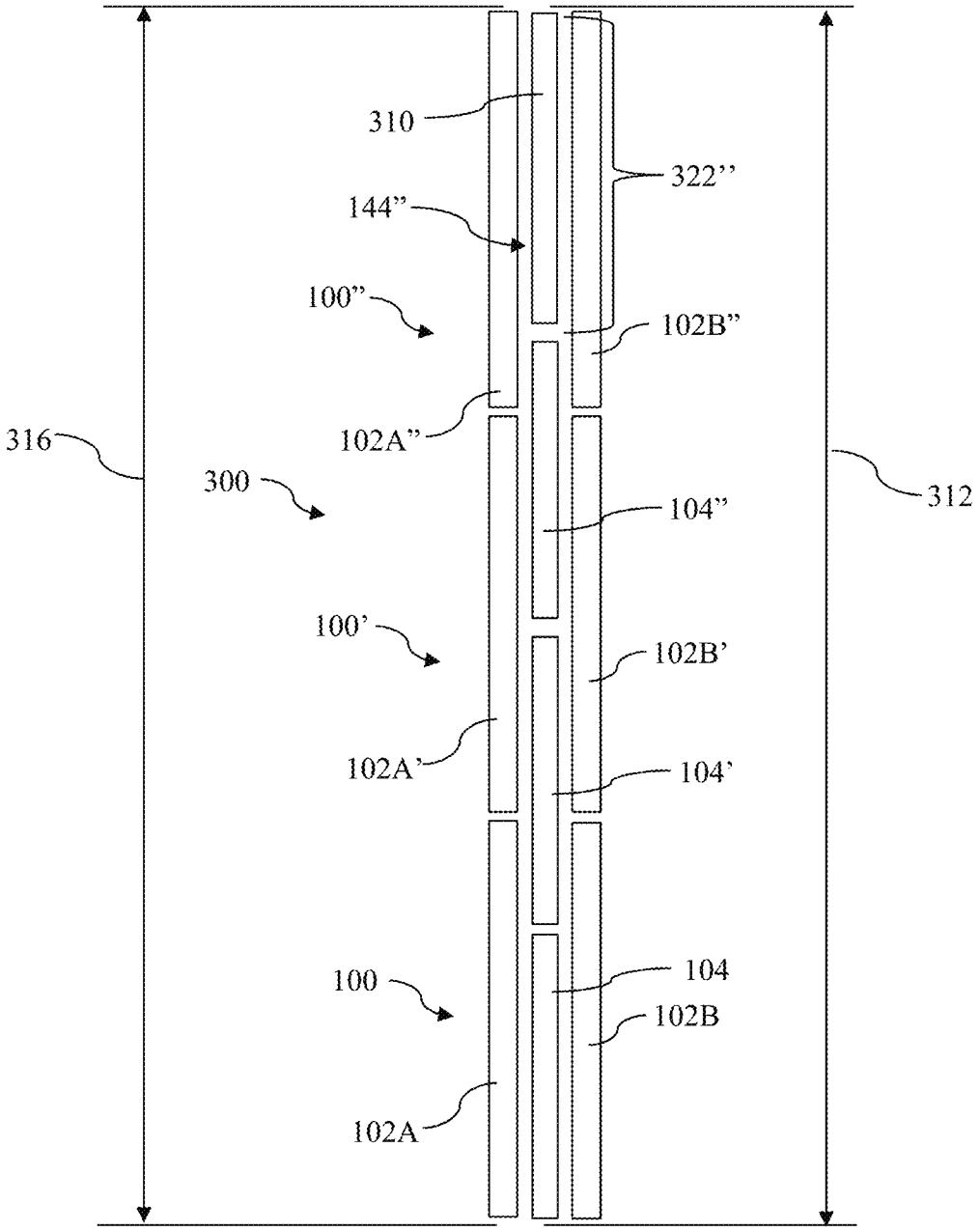
Figure 13:
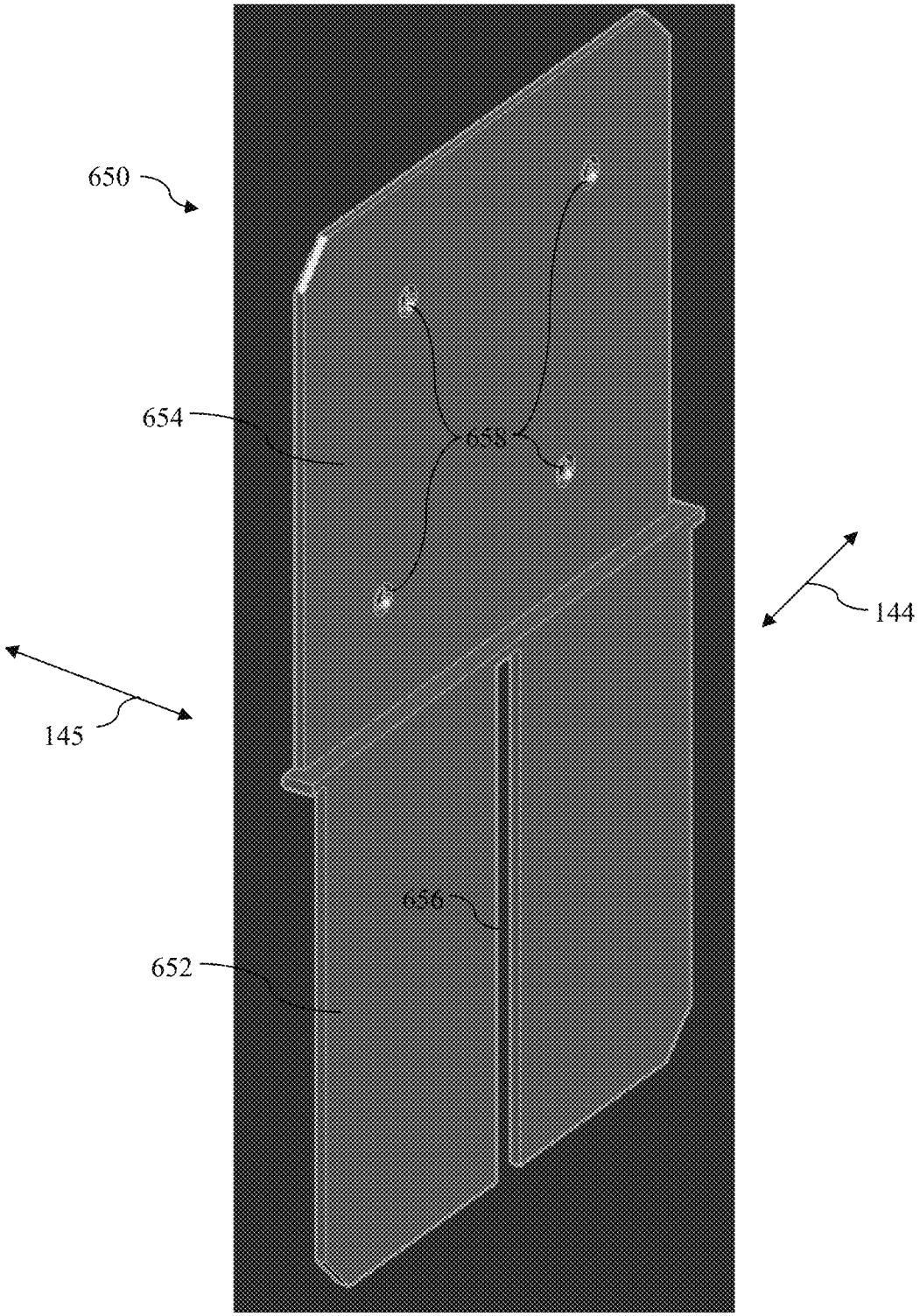
FIG. 13 is a perspective view of a coupling bracket for attaching adjacent outer channel members.

Optionally, with reference to FIGS. 4, 5, and 13, a coupling plate 650 can be disposed on each side of the inner member 104 in the second transverse dimension 145. The coupling plate 650 can have a first generally planar portion 652 and a second generally planar portion 654. The first generally planar portion 652 can be disposed at least partially within the internal passage 142 of the structural member assembly 100. The first generally planar portion 652 can have a slot 656 that is sized and centered in the first transverse dimension 144 to receive adjacent pairs of first flanges 130A, 130B and second flanges 132A, 132B (FIG. 2). A face of the first generally planar portion 652 can abut the first and second side walls' interior surfaces of the first and second channel members 102A, 102B, and fasteners can attach the coupling plate 650 to the first and second channel members. The second generally planar portion 654 can extend above the top ends (i.e., the first ends 160A, 160B) of the first and second channel members 102A, 102B. The second generally planar portion 654 can be offset from the first generally planar portion 652 in the second transverse dimension 145 so that the second portion 654 can extend to an outside of an adjacent pair of first and second channel members 102A', 102B' (FIG. 6C). Fasteners can extend through holes 658 to attach the adjacent pair of first and second channel members 102A', 102B'. In this way, adjacent longitudinal ends of adjacent structural member assemblies' first and second channel members can be can be aligned and attached to each other.

Referring to FIG. 2, it can be desirable to position each inner member 104 so that its base wall 170 extends at or near the center of the interior passage 142 in the second transverse dimension 145. Referring also to FIGS. 4, and 9-11, an alignment bracket 600 can be disposed between adjacent inner members 104, 104'. The alignment bracket 600 can have a generally rectangular profile having a length 602 and a width 604. The length 602 and width 604 can be selected so that the alignment bracket 600 can be received within the interior passage 142 so that its rectangular profile is perpendicular to the longitudinal dimension 101. The alignment bracket 600 can comprise notches 606 to receive the first and second flanges 130A, 130B, 132A, 132B (FIG. 2). Circumferential surfaces of the alignment bracket can have a small clearance from the first and second outer channel members' inner surfaces so that the first and second outer channel members' respective inner surfaces constrain the alignment bracket in the first and second transverse dimensions 144, 145.

The alignment bracket 600 can have a depending flange 610 that extends downward and generally perpendicularly to the rectangular profile of the alignment bracket. The depending flange 610 can be disposed adjacent a base wall 170 of the inner member 104, and the pair can be coupled with fasteners 150. In this way, the top end of the inner member 104 can be positioned within the interior passage 142.

The alignment bracket 600 can have a circumferential upwardly extending projection 620 that defines a gap 622 on each side for receiving the inner member 104' therein. For example, the circumferential upwardly extending projection 620 can comprise first edges 624 and second edges 226 that extend in the longitudinal dimension 101 and are spaced from each other in the second transverse dimension 145. The first edge 624 can define a first stop to constrain a back surface (e.g., an outer surface of the base wall 170 (FIG. 2)) of the inner member 104, and the second edge 624 can define a second stop to constrain a front surface (e.g., an outer surface of the first/second flanges 176, 178 (FIG. 2)) of the inner member 104'. The alignment bracket 600 can therefore constrain the position of the bottom end of the inner member 104'. In this way, the inner members can be positioned within the interior passage 142. It should be understood that, although the embodiments illustrate the alignment bracket 600 orienting the top and bottom ends of the inner member, it should be understood that the alignment bracket 600 could be vertically inverted to position opposing ends of inner members within an interior passage of first and second channel members. Moreover, in view of this disclosure, alternative designs of alignment brackets that position the inner member within the first and second channel members will be apparent to one skilled in the art.

Figure 12:
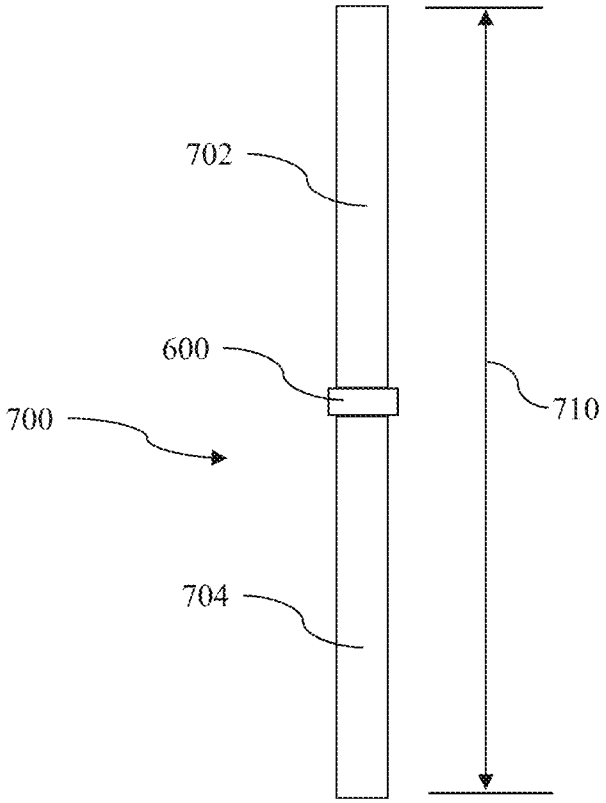
FIG. 12 is a schematic of an inner member in accordance with embodiments disclosed herein.
Figure 14A:
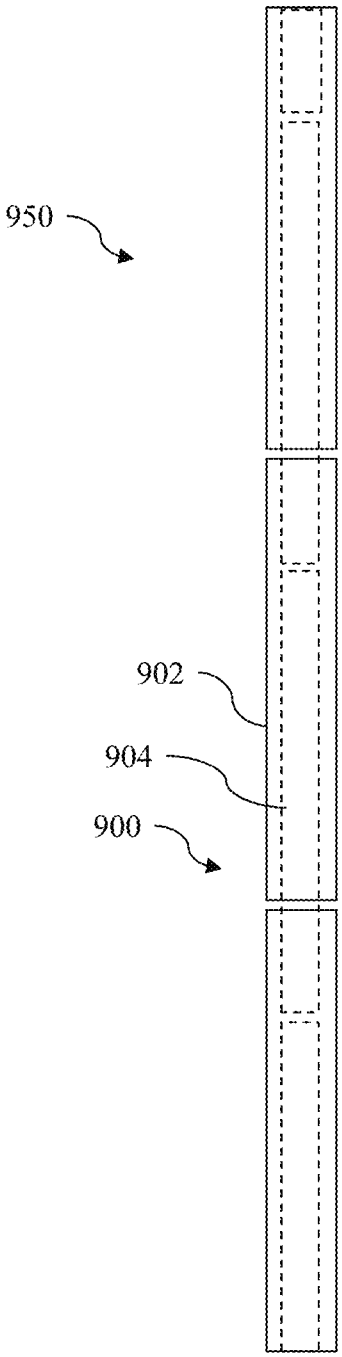
FIG. 14A is a schematic view of still another support column.
Figure 14B:
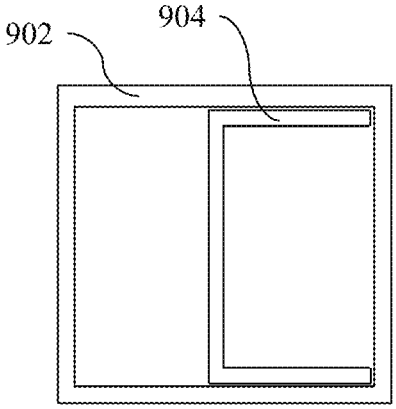
FIG. 14B is a cross sectional view of the support column of FIG. 14A, illustrating a structural member assembly comprising a structural tube and a center member.

Although the disclosure refers to the inner member 104 as a unitary body, it should be understood that, in some embodiments, the inner member 104 can comprise a plurality of coupled components. For example, referring to FIG. 12, an inner member 700 in accordance with embodiments of the present disclosure can comprise a first portion 702 having a first length, a second portion 704 having a second length. The first portion 702 and second portion 704 can be separated by an alignment bracket 600. Although not a unitary body, the inner member 700 can provide structural support to its structural member assembly along its length 710. Although the structural member assemblies are described herein as comprising first and second outer channel members, in various aspects, a structural member 100 can comprise an outer structural tubing member (i.e., hollow structural sections, or "HSS") and an inner member. Referring to FIGS. 14A and 14B, a support column 950 can comprise a plurality of structural member assemblies 900. The structural member assemblies 900 can each comprise an outer tubing member 902 and an inner member 904. The outer tubing member 902 can have, in a cross sectional plane perpendicular to the structural member assembly's longitudinal dimension, a hollow rectangular profile. The inner member 904 can comprise a channel member or HSS member. The inner member 904 can couple to the outer tubing member 902. The respective longitudinal ends of the inner members 904 can be offset from respective longitudinal ends of the outer tubing members to enable the structural member assemblies 900 to be stacked, as disclosed herein, to create the support column 950.

Structural member assemblies 100 and support columns 300, as discussed herein, can provide various improvements over known structural members. According to one aspect, the structural member assemblies 100 can be made partially or entirely of light gauge steel, thereby providing structural support at a low weight and cost. Moreover, the ends of the inner members that are offset from the ends of the outer channel members enable the structural member assemblies 100 to be nested so that adjacent structural member assemblies can easily be stacked to create support columns 300. Additionally, the inner members 104 of the support columns 300 not only provide surface for coupling adjacent structural member assemblies 100; the inner members 104 can provide structural support to the support columns 300. According to some aspects, a plurality of inner members 104 can cooperate to define an inner support that extends along an entire length, or substantially an entire length, of the support column 300. That is, the center supports 104 can provide both surfaces for easy attachment of adjacent structural member assemblies and structural support along the entire length of the support column. Because the structural member assemblies 100 can be stacked as disclosed, the cross sectional profiles of respective structural assemblies, in planes perpendicular to the longitudinal dimension, can be the same. Accordingly, disclosed embodiments can be distinguished from conventional assemblies that employ nested members having sequentially smaller cross sections. Optionally, the columns 300 can be used in multi-level construction, such as for multi-level storage structure buildings. The disclosed structural members can have improved load carrying capacity and strength over conventional structural members. Further, the disclosed columns having structural members with offset ends can have greater shear strength than conventional systems. For example, in conventional multi-level storage structure buildings, structural columns have longitudinal ends that terminate at each floor, wherein adjacent columns are coupled at adjoining ends to create unions having weak shear strength. In contrast, the disclosed embodiments can create a single continuous structural column that does not have unions with weak shear strength. Improved shear strength can be particularly critical for providing stability in seismic or earthquake zones.

Referring to FIGS. 4 and 5, the structural member assemblies 100 and support columns 300 can be used to create a structural frame. A portion of a structural frame can comprise a structural member assembly 100 and a transversely extending beam 800. The transversely extending beam 800 can comprise a first channel member 802, a second channel member 804, and a bridge channel member 806. Each of the first channel member 802, the second channel member 804, and the bridge channel member 806 can have C-shaped cross sections. The first channel member 802 can couple via fasteners 150 to the base wall 106A of the structural member assembly's first outer channel member 102A, and the second channel member 804 can couple to the base wall 106B of the structural member assembly's second outer channel member 102B. In this configuration, the first channel member 802 and second channel member 804 are oriented so that their respective channels open away from each other. In this configuration, the first channel member 802 and second channel member 804 can abut and attach to the support column 300 without modification of said first and second channel member 802, 804. It can be appreciated that if a pair of members have legs extending toward each other, said members have to first be modified to remove at least portions of said legs in order to abut the pair of members to the support column for attachment thereto, the modification of which can reduce the structural integrity of the members. Thus, the first and second channel members 802, 804 can, without modification, be used in compound span configurations. That is, the first and second channel members 802, 804 can extend across, and attach to, three or more support columns, as opposed to just extending between two adjacent support columns, as in a simple span configuration. The bridge channel member 806 can have a width in the first transverse dimension 144 that is equal to the width of the structural member assembly 100 in the same dimension. Accordingly, the bridge channel member 806 can extend between, and attach to each of, the first channel member 802 and the second channel member 804. In this way, the horizontal transversely extending beam 800 can be coupled to the structural member assembly 100 to support a floor of a multi-story storage structure. Although disclosed herein as coupling to the support columns 300, it should be understood that the beams 800 can be used with any other column type, such as, for example, conventional heavy gauge steel columns as are known in the art. Further, it should be understood that, although particular embodiments of transverse structures are disclosed in detail herein, various other transverse structures/beams can be coupled to, and supported by, support columns 300. For example, in another embodiment, a horizontally oriented support column 300 can be attached to a vertically oriented support columns 300 via one or more gussets. Transversely extending beams 800 can alternatively be any conventional beam known in the art.

Figure 15:
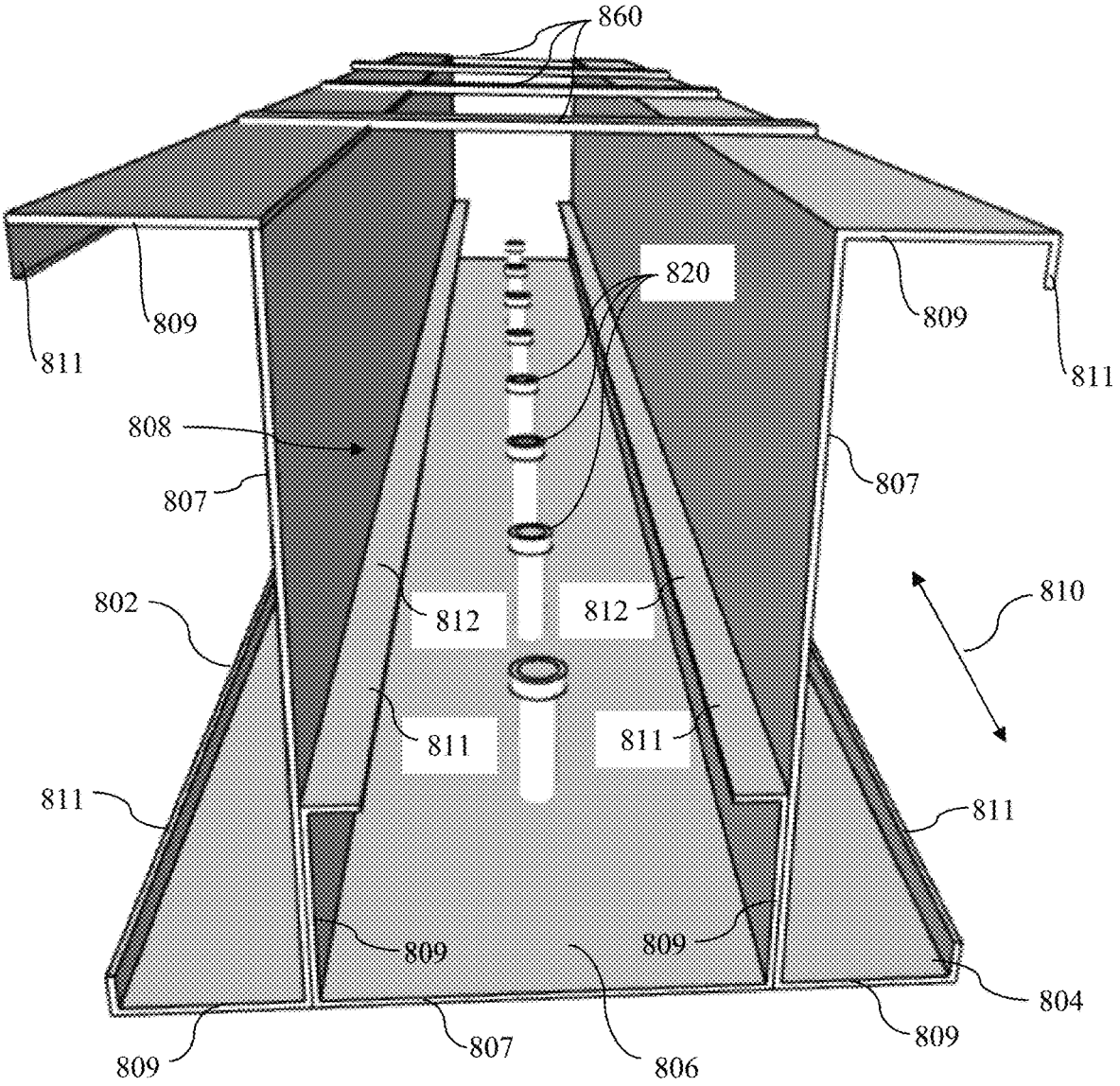
FIG. 15 illustrates a cross sectional perspective view of a beam having a plurality of internally projecting members therein.

Referring to FIGS. 4, 5, and 15 according to further aspects, the beam 800 can define an interior volume 808 and have a longitudinal axis 810. The interior volume 808 can receive concrete to form a composite beam. In some optional aspects, the concrete can be pumped into the interior volume 808 from the bottom of the beam rather than filling from the top down. In further optional aspects, the concrete can be 3000 psi concrete. As described above, each of the first channel member 802, second channel member 804, and the bridge channel member 806 can have C-shaped profiles. That is, each channel member can comprise, in cross sections perpendicular to each channel's longitudinal dimension, a base wall 807, first and second side walls 809 extending perpendicularly from the base wall 807, and respective first and second flanges 811 extending toward each other from distal ends of the first and second side walls 809. Each channel member can thus define a channel opening, opposite the base wall, between the first and second flanges. Each channel member can have an opening direction defined as a direction from the channel member's base wall to its opening. The first channel member 802 and second channel member 804 can be oriented so that their respective channel openings face away from each other. Accordingly, outer surfaces (i.e., surfaces opposite each channel's interior) of the first channel member 802 and second channel member 804 can define side walls of the beam's interior volume 808. In this way, the first channel member 802 and second channel member 804 can provide flat surfaces for abutting the support column 300 without any need for modification. The bridge channel member 806 can be oriented so that its channel opens upwardly. In this way, the bridge channel member 806 can define a lower surface of the beam's interior volume 808. Each of the first channel member 802, second channel member 804, and the bridge channel member 806 can comprise light gauge steel. In exemplary aspects, the first channel member 802, the second channel member 804, and the bridge channel member 806 can be secured together by bolts or other fasteners. However, it is also contemplated that the bridge channel members disclosed herein could be formed together as a single, unitary or monolithic structure.

In providing the bridge channel member 806 with a C-shaped profile, the bridge channel member 806 can define flanges 812 that extend inwardly into the beam's interior volume 808 and engage the concrete to increase the composite beam's overall strength. Prior to hardening/curing of the concrete, it is contemplated that the concrete can be positioned both above and below each flange 812 such that the flange is surrounded by or embedded within the concrete. After hardening/curing of the concrete, it is contemplated that the flange can provide support to the concrete during flexing or other movement of the beam and distribute forces between the concrete and the steel channel members. In some embodiments, the flanges can extend into the interior volume 808 at about one third of the height of the beam. That is, the length of the first and second legs of the bridge channel member 806 can be about one third of the height of the beam. Accordingly, for a six inch tall beam, the flanges can extend inwardly at about two inches from the bottom of the beam.

Additionally, or alternatively, the beam 800 can comprise a plurality of internally projecting members 820 that are spaced along the beam's longitudinal axis 810. The internally projecting members 820 can be configured to engage the concrete to distribute forces between the concrete and the steel channel members. Prior to hardening/curing of the concrete, it is contemplated that the concrete can be positioned to surround or embed the internally projecting members 820 within the concrete. After hardening/curing of the concrete, it is contemplated that the projecting members 820 can provide support to the concrete during flexing or other movement of the beam and distribute forces between the concrete and the steel channel members.

Referring to FIG. 15, according to a first embodiment, the internally projecting members 820 can comprise shoulder bolts 822 that extend through holes in the bridge channel member 806 and attach via nuts on a bottom side of the bridge channel member 806. It can be appreciated that conventional composite beams comprise heavy gauge steel that allows shear studs to be welded thereto for engaging the concrete. However, welding such shear studs to light gauge steel can be difficult or impossible. Moreover, welding in field applications can be time consuming and cause difficulty in maintaining quality control. Accordingly, using shoulder bolts as disclosed herein for engaging the concrete overcomes the challenge of attaching shear studs via weldment. Further, shoulder bolts require only one nut for attachment, and the shoulder can provide for installation at a consistent desired height and a measurable engagement between the concrete and the steel after concrete has filled the beam. The shoulder bolts can be selected from various sizes, depending on the application, without requiring specialized tooling to manufacture. The shoulder bolts can optionally be about two inches long and have a shoulder diameter of at least one quarter of an inch. In further optional embodiments, the shoulder bolts can have various dimensions, including shoulder sizes from one to ten inches in length and one quarter to one inch in diameter.

Figure 16:
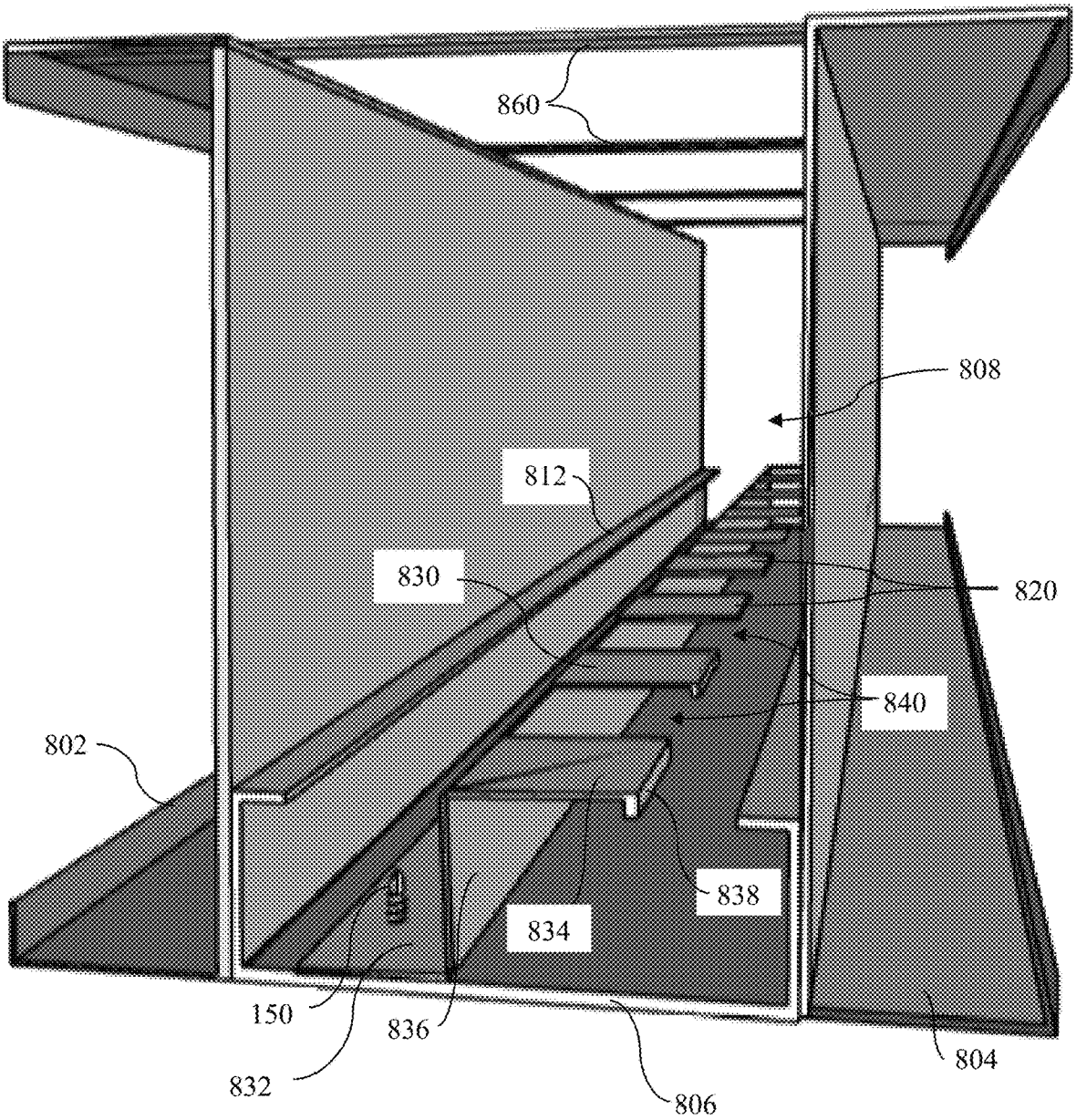
FIG. 16 illustrates a cross sectional perspective view of a beam having a plurality of internally projecting members therein, wherein the internally projecting members comprise portions of a reinforcement member.

Referring to FIG. 16, in a second embodiment, the internally projecting members 820 can comprise portions of a Z-channel structure 830. The Z-channel structure 830 can optionally comprise light gauge steel. The Z-channel structure 830 can comprise, in cross sections perpendicular to the Z-channel structure's longitudinal axis, a lower wall 832, a plurality of planar or generally planar upper tabs 834 that are parallel to, or generally parallel to, the lower wall 832, and a plurality of web sections 836 extending between the lower wall 832 and the upper tabs 834. According to various aspects, the beam can have a height that is fifty percent greater than the beam's width. Thus, according to at least one embodiment, the beam can be four inches in width and six inches in height. The web sections can optionally extend about one third of the beam's height, or one half of the beam's width. Accordingly, in some embodiments, the web sections 836 can extend vertically by about two inches, and the upper tabs 834 can extend horizontally along a transverse axis, perpendicular to the longitudinal axis 810, by about two inches. Thus, in some embodiments, the flanges 812 of the bridge channel member 806 can be approximately coplanar with to the upper tabs 834. In some embodiments, the Z-channel structure 830 can further comprise a downwardly extending return flange 838 that extends perpendicularly to, and at a distal edge of, the upper tabs 834. The return flange 838 can optionally extend vertically (downwardly) about ⅝ of an inch. Gaps 840 are disposed between sections of the upper tabs 834 and web portions 836. The gaps 840 can extend longitudinally between about 6" inches and about 12" inches. Having gaps 840 with such spacing can optimize composite action between the steel members and the concrete. In some embodiments, the Z-channel structure 830 can be manufactured by removing sections of a continuous Z-channel, thereby leaving the upper portion 834 and web portion 836. The lower wall 832 can provide a base that can be attached via mounting hardware 150 to the bridge channel member 806. The mounting hardware 150 can further engage the concrete to enhance composite action. Similarly, the mounting hardware 150 that attach the first and second channel members 802, 804 to the support columns 300 (e.g., heads of self-tapping screws) can further enhance composite action between the steel members and the concrete. In using a Z-channel structure as disclosed herein, composite engagement between the concrete and the steel components can be increased by 14-25% over conventional methods. As should be apparent to one skilled in the art, in further embodiments, a U-shaped channel or a C-shaped channel can similarly be modified to provide internally protruding web sections and upper tabs connected by a longitudinally continuous web.

Figure 17:
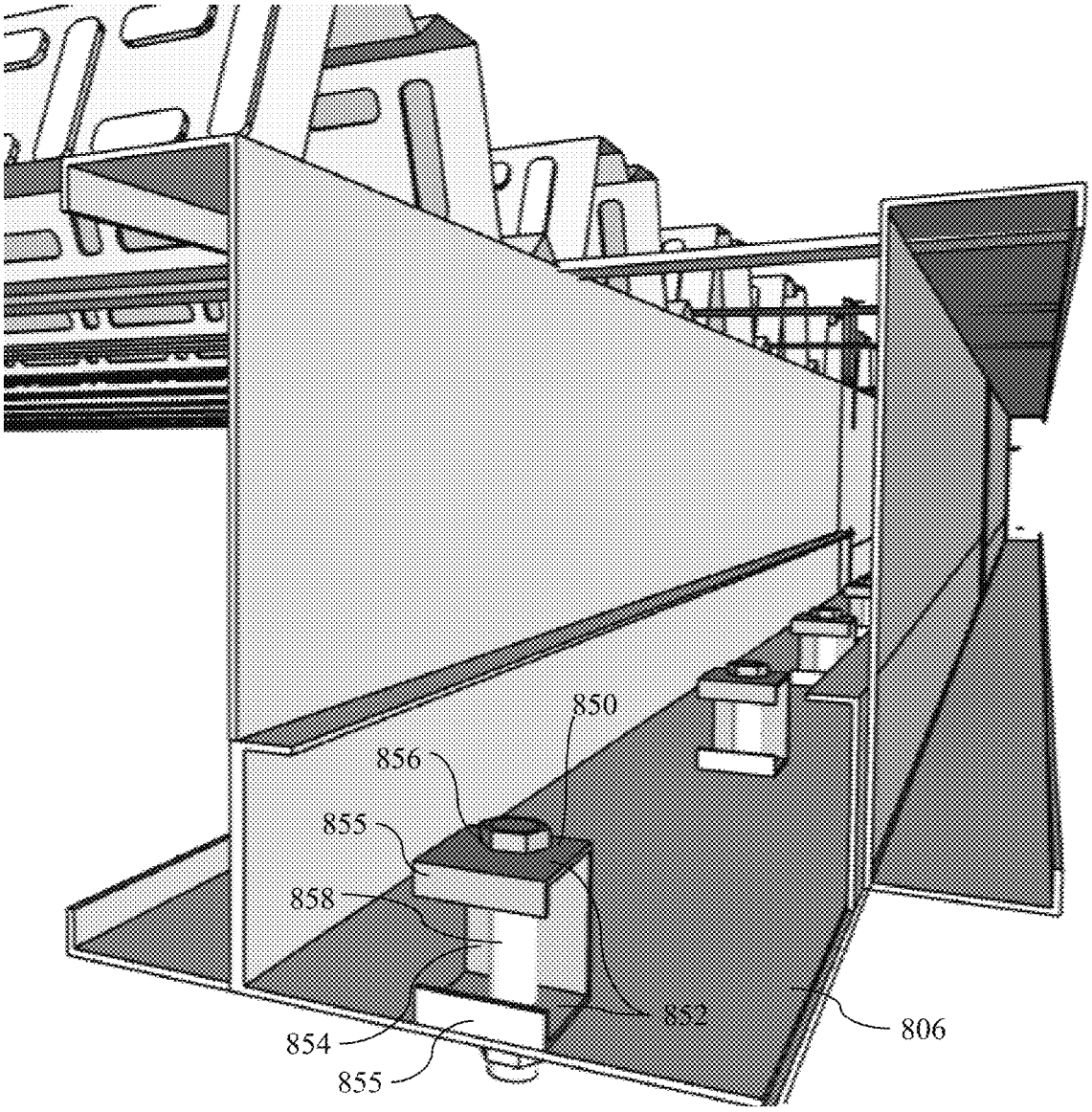
FIG. 17 illustrates a partial perspective view of a beam with an alternative embodiment of internally projecting members.
Figure 18:
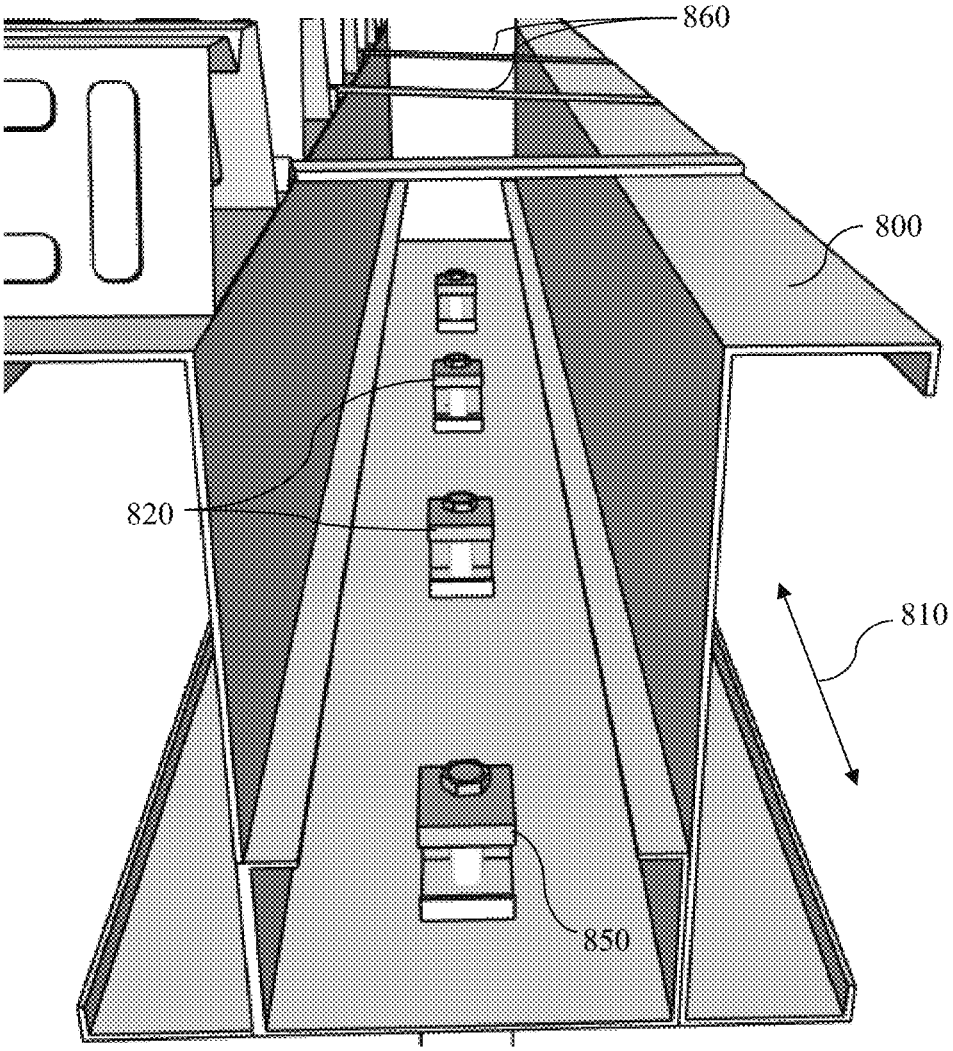
FIG. 18 illustrates a cross sectional perspective view of the beam of FIG. 17.

Referring to FIGS. 17 and 18, in a third embodiment, each of the internally projecting members 820 can comprise a C-shaped component 850 (i.e., having generally parallel plate portions 852 that are connected by a web 854 and flanges 855 that extend toward each other from distal ends of respective parallel plate portions 852). The parallel plate portions 852 can comprise aligned and concentric throughholes 856 that receive a bolt 858 therethrough. In this way, the C-shaped components 850 can be bolted to the bridge channel member 806 at spaced intervals along the longitudinal axis 810. The C-shaped components 850 can be oriented so that the direction of extension of the parallel plates 852 from their respective webs 854 is parallel to the longitudinal axis 810 of the beam 800. The web 854 can extend vertically about two inches, and the parallel plate portions 852 can extend approximately two inches along the longitudinal axis 810. In various further embodiments, the web 854 and parallel plate portions 852 can optionally extend vertically about one third of the height of the first and second channels 802, 804 (i.e., the beam's height). The C-shaped components 850 can have a gauge thickness that is at least as thick as the gauge thickness of the bridge channel member 806. In further embodiments, the internally projecting members 820 can have U-shaped profiles and be configured like the C-shaped components 850 as disclosed above. The C-shaped components 850 can optionally comprise steel or any combination of material and thickness that is stronger than the bridge channel member 806.

Figure 19:
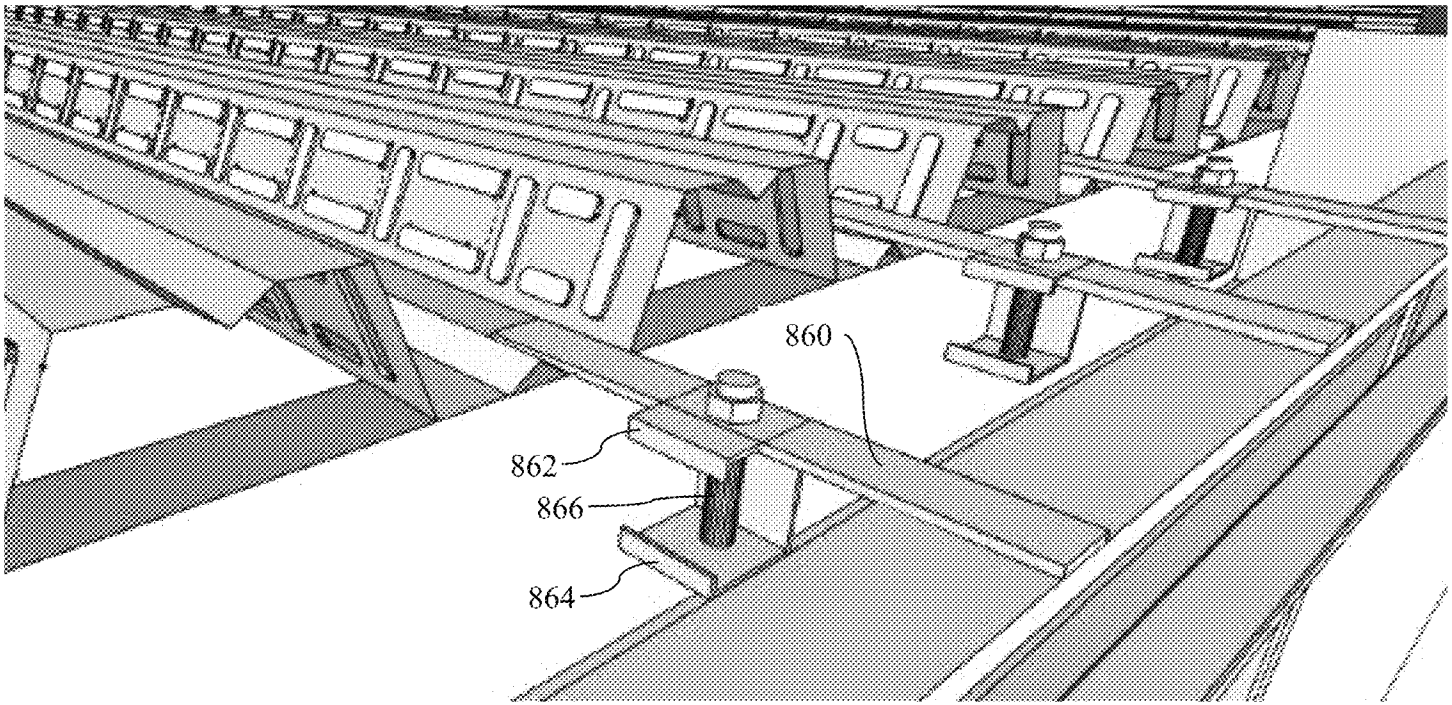
FIG. 19 illustrates a perspective view of the beam having a plurality of straps and depending internally projecting components depending therefrom.

Referring to FIGS. 16 and 18, straps 860 can extend across the channel interior volume 808 defined by the beam 800. The straps 860 can attach to the upper surfaces of the first and second channel members 802, 804 via screws or other fasteners or via weldment. Concrete can fill the beam 800 beyond the straps 860 so that the straps can engage the concrete. After curing/hardening of the concrete, it is contemplated that the straps 860 can be configured to support the concrete within the beam and transmit forces from the concrete to the steel beam structure. Referring also to FIG. 19, in some embodiments, depending internally projecting components 862 can attach to, and extend downward from, the straps 860 to engage the concrete. It should be understood that concrete has excellent compressive strength, while steel has excellent tensile strength. During use, as the beam is loaded, portions of the beam can be in tension, while other portions of the beam can be in compression, and the stress in the beam can transition at a transition height along the beam's height. The depending internally projecting components 862 can extend to the transition height in order to transfer tension from the concrete to the steel beams, which possess excellent tensile strength. The transition height can vary as a function of the beam's size, shape, depth, and width. In some embodiments, the transition height can be between about one quarter and one half of the beam's height, and, in some embodiments, at about one third of the beam's height as measured from the top of the beam (i.e., from about one-half to about three-quarters of the beam's height as measured from the bottom of the beam and, in some embodiments, about two-thirds of the beam's height as measured from the bottom of the beam). In further embodiments, the transition height can be at about 15% of the beam's height as measured from the top of the beam (i.e., about 85% of the beam's height as measured from the bottom of the beam). In some embodiments, the depending internally projecting components 862 can comprise depending C-shaped components 864. Attachment hardware 866 (e.g., a bolt and nut, as shown) can attach each of the depending C-shaped components 864 to a respective strap 860. The depending C-shaped components 864 can attach so that the screw extends parallel to the C-shaped component's web and through the C-shaped component's parallel wall portions. In various other embodiments, the depending internally projecting components 862 can have other shapes and structures. For example, in some embodiments, the depending internally projecting components 862 can comprise shoulder bolts that extend downwardly from the straps 860.

Each of the internally projecting members 820, return flanges 838, straps 860, and depending internally projecting components 862 can enhance the engagement between the steel members and the concrete to provide a composite beam having improved strength over conventional beams. Because the transition height, as disclosed above, can vary, based on parameters of the beam, the combination of the internally projecting members 820, return flanges 838, straps 860, and depending internally projecting components 862 provides for composite action along the height of the beam, enabling composite action closest to the transition height, regardless of the position of said transition height along the height of the beam. The disclosed configuration can further be cheaper to manufacture and more simple to assemble, thereby reducing assembly time over conventional framing methods. Many or all of the components of the beam 800 can be off-the-shelf items, thereby providing for low cost and easy procurement. As the beams 800 can be attached to columns in a compound span configuration, the beams can be attached more easily and in a configuration having greater overall strength than conventional simple span beams. Additionally, the disclosed embodiments enable easier field modification than conventional trough designs; because the beam spans across columns rather than fitting between the columns, the beam's steel channel members can be cut in situ. Moreover, conventional beams comprise heavy gauge steel, which can increase cost and weight without substantially enhancing the strength of the beam. Accordingly, the light gauge steel can decrease the cost and the weight of the beam.

Although disclosed as separate and independent components, it is contemplated that any of the beam structures disclosed herein can be used in combination with any of the structural member assemblies disclosed herein to form a support structure for a building or other construction.

EXEMPLARY ASPECTS

In view of the described products, systems, and methods and variations thereof, herein below are described certain more particularly described aspects of the invention. These particularly recited aspects should not however be interpreted to have any limiting effect on any different claims containing different or more general teachings described herein, or that the "particular" aspects are somehow limited in some way other than the inherent meanings of the language literally used therein.

Aspect 1: A beam having an upper surface and comprising: a plurality of steel channel members that extend along a longitudinal axis, wherein the plurality of steel channel members cooperate to define an interior volume that is configured to receive concrete therein, wherein the plurality of steel channel members comprises a first C-shaped channel member defining a channel therein and having: a base wall; first and second side walls extending perpendicularly from the base wall; and first and second flanges respectively inwardly extending from the first and second side walls, wherein the channel of the first C-shaped channel member defines a portion of the interior volume, and wherein the first and second flanges extend into the interior volume; a plurality of internally projecting members spaced along the longitudinal axis, wherein the plurality of internally projecting members are coupled to the base wall of the first C-shaped channel member and extend into the interior volume; and a strap secured to the upper surface of the beam and extending across the interior volume so that when the interior volume is filled with concrete, the strap engages the concrete.

Aspect 2: The beam of aspect 1, wherein the plurality of steel channel members further comprises: a second C-shaped channel member defining a channel therein and having an outer surface opposite the channel; and a third C-shaped channel member defining a channel therein and having an outer surface opposite the channel, wherein the second and third C-channels are disposed so that their respective channels open away from each other, wherein the first C-shaped channel extends between the second and third C-shaped channels, and wherein the channel of the first C-shaped channel member and outer surfaces of the second C-shaped channel member and the third C-shaped channel member cooperate to define at least a portion of the interior volume.

Aspect 3: The beam of aspect 1 or aspect 2, wherein the plurality of inwardly projecting members comprises a plurality of shoulder bolts that are bolted to at least one steel channel member of the plurality of steel channel members.

Aspect 4: The beam of any of the preceding aspects, further comprising a generally planar wall that is elongated along the longitudinal axis and attached to the base wall of the first steel channel member, wherein each inwardly projecting member of the plurality of inwardly projecting members comprises: a web section extending upwardly from the generally planar wall, the web section having a distal end; and a generally planar tab extending perpendicularly to, and from the distal end of, the web section.

Aspect 5: The beam of aspect 4, wherein each generally planar tab has a distal end, and wherein each inwardly projecting member of the plurality of inwardly projecting members further comprises a flange extending generally perpendicularly to the distal end of the generally planar tab.

Aspect 6: The beam of aspect 4 or aspect 5, wherein the internally projecting members are spaced apart by between about 6 inches and about 12 inches.

Aspect 7: The beam of any of the preceding aspects, further comprising a plurality of depending internally projecting components attached to, and extending downward from, the plurality of straps.

Aspect 8: The beam of aspect 7, wherein the depending internally projecting components comprise a pair of parallel portions and a web extending vertically between the parallel portions.

Aspect 9: The beam of aspect 7 or aspect 8, wherein at least one of the plurality of depending internally projecting components extends down from a respective strap of the plurality of straps by at least 33% of a height of the beam.

Aspect 10: The beam of any of the preceding aspects, wherein each of the plurality of steel channel members comprises light gauge steel.

Aspect 11: The beam of any of the preceding aspects, wherein the plurality of internally projecting members comprise a plurality of C-shaped components that are attached to the first C-shaped channel member.

Aspect 12: The beam of any of the preceding aspects, further comprising concrete cured within the interior volume, wherein the first and second flanges of first C-shaped channel member, the plurality of internally projecting members, and the strap are engaged with the cured concrete.

Aspect 13: A beam comprising: a plurality of steel channel members that extend along a longitudinal axis, wherein the plurality of steel channel members cooperate to define an interior volume that is configured to receive concrete therein; and a reinforcement member disposed within the interior volume and attached to a steel channel member of the plurality of steel channel members, the reinforcement member comprising: a generally planar wall extending along the longitudinal axis, a plurality of web sections extending upwardly from the generally planar wall, each web section having a respective distal end; and a plurality of generally planar tabs, each generally planar tab extending from the distal end of a respective web section of the plurality of web sections.

Aspect 14: The beam of aspect 13, wherein the reinforcement member further comprises a plurality of flanges, each flange of the plurality of flanges extending generally perpendicularly to the distal end of a respective generally planar tab.

Aspect 15: The beam of aspect 13 or aspect 14, wherein the adjacent web sections are spaced apart by between about 6 inches and about 12 inches.

Aspect 16: The beam of any of aspects 13-15, wherein the beam has an upper surface and further comprises a plurality of straps secured to the upper surface of the beam and extending across the interior volume.

Aspect 17: The beam of aspect 16, further comprising a plurality of depending internally projecting components attached to, and extending downward from, the plurality of straps.

Aspect 18: The beam of aspect 17, wherein the depending internally projecting components comprise a pair of parallel portions and a web extending vertically between the parallel portions.

Aspect 19: The beam of aspect 17 or aspect 18, wherein at least one of the plurality of depending internally projecting components extends down from a respective strap of the plurality of straps by at least 33% of a height of the beam.

Aspect 20: The beam of any of aspects 13-19, wherein each of the plurality of steel channel members comprises light gauge steel.

Aspect A1: A structural member assembly extending in a longitudinal dimension, the structural member assembly comprising: a first channel member having a first longitudinal end and an opposed second longitudinal end, wherein the first channel member has a length in the longitudinal dimension and defines an inner channel extending along the length; a second channel member having a first longitudinal end and an opposed second longitudinal end, wherein the second channel member has a length in the longitudinal dimension and defines an inner channel extending along the length; and an inner member having a first longitudinal end and an opposed second longitudinal end, wherein the inner member has a length in the longitudinal dimension, wherein the first and second channel members are positioned with respect to each other so that the inner channels of the first and second channel members cooperate to define an interior passage extending in the longitudinal dimension, wherein the inner member extends through at least a portion of the interior passage and is attached to at least one of the first channel member and the second channel member, wherein at least one of the first and second longitudinal ends of the inner member is longitudinally spaced from a respective longitudinal end of the first channel member and a respective longitudinal end of the second channel member, wherein the length of the inner member is greater than half of the length of the first channel member and greater than half of the length of the second channel member.

Aspect A2: The structural member assembly of aspect A1, wherein each of the first channel member, the second channel member, and the center member comprises light gauge steel.

Aspect A3: The structural member assembly of aspect A1, wherein each of the first channel member and the second channel member, in a cross sectional plane perpendicular to the longitudinal dimension, comprises a base wall having an inner surface, an outer surface, a first end, and a second end, a first side wall extending from the first end of the base wall, a second side wall extending from the second end of the base wall, wherein the base wall, the first side wall, and the second side wall cooperate to define the inner channel, and wherein the first and second channel members are positioned with respect to each other so that the inner surface of the base wall of the first channel member opposes the inner surface of the base wall of the second channel member.

Aspect A4: The structural member assembly of aspect A3, wherein each of the first channel member and the second channel member, in the cross sectional plane, further comprises: a first flange extending from a first end of the first side wall that is opposite the base wall and in a direction toward the second side wall; and a second flange extending from a first end of the second side wall that is opposite the base wall and in a direction toward the first side wall.

Aspect A5: The structural member assembly of any one of aspects A1-A4, wherein each of the first channel member, the second channel member, and the center member, in the cross sectional plane, have the same shape.

Aspect A6: The structural member assembly of assembly of any one of Aspects A1-A5, wherein the length of the first channel member and the length of the second channel member are substantially equal.

Aspect A7: The structural member assembly of any one of aspects A1-A6, wherein said at least one of the first and second longitudinal ends of the inner member is longitudinally spaced from the respective longitudinal end of the first channel member and the respective longitudinal end of the second channel member by at least twelve inches.

Aspect A8: The structural member assembly of any one of aspects A1-A7, wherein the length of the inner member is greater than the length of the first channel member and greater than the length of the second channel member.

Aspect A9: The structural member assembly of aspect A8, wherein the inner member comprises a first portion and a second portion, wherein the first portion of the inner member is arranged end-to-end with the second portion of the inner member, wherein the first portion and the second portion are discrete components.

Aspect A10: The structural member assembly of any of aspects A1-A7, wherein the length of the inner member is less than the length of the first channel member and less than the length of the second channel member.

Aspect A11: The structural member assembly of any one of aspects A1-A10, wherein the inner member extends from a wall of the first member to an opposing wall of the second member.

Aspect A12: The structural member assembly of aspect A11, wherein the inner member comprises a first parallel wall, a second parallel wall, and a web extending between the first and second parallel walls, wherein the first wall of the inner member abuts and attaches to the wall of the first member, and the second parallel wall of the inner member abuts the opposing wall of the second member.

Aspect A13: The structural member assembly of any one of aspects A1-A12, wherein the structural member is a constituent of a multi-story storage structure.

Aspect A14: A support column extending in a longitudinal dimension, the support column comprising: a plurality of outer hollow longitudinal structures, each longitudinal structure having a first longitudinal end and an opposing second longitudinal end, and each longitudinal structure having a length in the longitudinal dimension and defining an interior passage extending along the length; and a plurality of inner members, each inner member having a first longitudinal end and an opposed second longitudinal end and having a length in the longitudinal dimension, wherein the plurality of outer hollow longitudinal structures are aligned end-to-end along a single axis, wherein respective longitudinal ends of each of the outer hollow longitudinal structures are coupled to respective longitudinal ends of each adjacent outer hollow longitudinal structure, wherein the interior passages of the plurality of outer hollow longitudinal structures cooperate to define an interior passage of the support column, wherein the plurality of inner members are aligned end-to-end along the single axis within the interior passage of the support column so that the first and second longitudinal ends of each of the inner members extend to respective longitudinal ends of each adjacent inner member, wherein at least one end of at least one inner member is longitudinally offset from every longitudinal end of the plurality of outer hollow longitudinal structures.

Aspect A15: The support column of aspect A14, wherein each outer hollow longitudinal structure comprises: a first channel member having a first longitudinal end and an opposed second longitudinal end, wherein the first channel member has a length in the longitudinal dimension and defines an inner channel extending along the length; and a second channel member having a first longitudinal end and an opposed second longitudinal end, wherein the second channel member has a length in the longitudinal dimension and defines an inner channel extending along the length; and wherein each of the first channel member and the second channel member, in a cross sectional plane perpendicular to the longitudinal dimension, comprises a base wall having an inner surface, an outer surface, a first end, and a second end, a first side wall extending from the first end of the base wall, a second side wall extending from the second end of the base wall, wherein the base wall, the first side wall, and the second side wall cooperate to define the inner channel, wherein the first and second channel members are positioned with respect to each other so that the inner surface of the base wall of the first channel member opposes the inner surface of the base wall of second channel member, and so that the inner channels of the first and second channel members cooperate to define the interior passage extending in the longitudinal dimension.

Aspect A16: The support column of aspect A15, wherein each inner member extends from a wall of the first channel member of at least one outer hollow longitudinal structure to an opposing wall of the respective second channel member of the at least one outer hollow longitudinal structure.

Aspect A17: The support column of aspect A16, wherein each of the inner members comprises a first parallel wall, a second parallel wall, and a web extending between the first and second parallel walls, wherein the first wall of the inner member abuts and attaches to the wall of the first channel member of the at least one outer hollow longitudinal structure, and the second parallel wall of the inner member abuts the opposing wall of the respective second channel member of the at least one outer hollow longitudinal structure.

Aspect A18: The support column of any one of aspects A14-A17, wherein each of the first channel member, the second channel member, and the center member comprises light gauge steel.

Aspect A19. A structural assembly extending in a longitudinal dimension, the structural assembly comprising: a first channel member, having a first longitudinal end and an opposed second longitudinal end, wherein the first channel member has a length in the longitudinal dimension and defines an inner channel extending along the length; a second channel member having a first longitudinal end and an opposed second longitudinal end, wherein the second channel member has a length in the longitudinal dimension and defines an inner channel extending along the length; and an inner member having a first longitudinal end and an opposed second longitudinal end, wherein the inner member has a length in the longitudinal dimension, wherein the first and second channel members are positioned with respect to each other so that the inner channels of the first and second channel members cooperate to define an interior passage extending in the longitudinal dimension, wherein the inner member extends through at least a portion of the interior passage and is attached to at least one of the first channel member and the second channel member, wherein at least one of the first and second longitudinal ends of the inner member extends beyond a respective longitudinal end of the first channel member and a respective longitudinal end of the second channel member in a first direction, wherein the first direction extends toward the respective longitudinal end of the first channel member from the opposing longitudinal end of the first channel member.

Aspect A20: The structural assembly of aspect A19, wherein each outer hollow longitudinal structure has the same cross sectional profile.

Aspect A21: The structural assembly of aspect A19, wherein each outer hollow longitudinal structure comprises structural tubing.

Aspect A22: A method comprising: coupling a first channel member to a first inner member and a second channel member to the first inner member, wherein the first channel member has a length, a first longitudinal end, and an opposing second longitudinal end, wherein the first channel member defines an inner channel extending along the length, wherein the second channel member has a length, a first longitudinal end, and an opposing second longitudinal end, wherein the second channel member defines an inner channel extending along the length, so that the inner channel of the first channel member and the inner channel of the second channel member oppose each other and cooperate to define a first interior passage therein and so that the first end of the first inner member defines a protruding portion that extends beyond the first end of the first channel member and the first end of the second channel member; coupling a third channel member and a fourth channel member to the protruding portion of the first inner member, wherein the third channel member has a length, a first longitudinal end, and an opposing second longitudinal end, wherein the third channel member defines an inner channel extending along the length, wherein the fourth channel member has a length, a first longitudinal end, and an opposing second longitudinal end, wherein the fourth channel member defines an inner channel extending along the length, so that the inner channel of the third channel member and the inner channel of the fourth channel member oppose each other and cooperate to define a second interior passage therein; coupling a second inner member to the third channel member and the fourth channel member so that the first inner member and the second inner member cooperate to define an inner member assembly that extends through an entire longitudinal length of the second interior passage.

Aspect A23: The method of aspect A22, wherein each of the first channel member, the second channel member, the third channel member, the fourth channel member, the first center member, and the second center member comprises light gauge steel.

Aspect A24: The method of aspect A22 or aspect A23, wherein each of the first channel member, the second channel member, the third channel member, the fourth channel member, in a respective cross sectional plane perpendicular to the longitudinal dimension, comprises a base wall having an inner surface, an outer surface, a first end, and a second end, a first side wall extending from the first end of the base wall in a respective direction that is perpendicular to the base wall, a second side wall extending from the second end of the base wall in the respective direction that is perpendicular to the base wall.

Aspect A25: The method of aspect A24, wherein each of the first channel member the second channel member, the third channel member, and the fourth channel member, in the respective cross sectional plane, further comprises: a first flange extending from a first end of the first side wall that is opposite the base wall and in a direction toward the second side wall; and a second flange extending from a first end of the second side wall that is opposite the base wall and in a direction toward the first side wall.

Aspect B1: A structural frame for a building, the structural frame comprising: a beam of any one of aspects 1-20; and a support column coupled to the beam.

Aspect B2: The structural frame of aspect B1, wherein the support column is a support column according to any one of aspects A14-A18.

Although the foregoing invention has been described in some detail by way of illustration and example for purposes of clarity of understanding, certain changes and modifications may be practiced within the scope of the appended claims.

What is claimed is:

1. A beam having an upper surface and comprising:

a plurality of steel channel members that extend along a longitudinal axis, the plurality of steel channel members comprising:

first and second channel members spaced along a transverse axis; and a bridge channel member extending between, and coupled to, the first and second channel members, wherein the bridge channel member comprises:

a base wall;

first and second side walls extending perpendicularly from the base wall; and first and second flanges respectively inwardly extending from the first and second side walls, wherein the plurality of steel channel members cooperate to define an interior volume that is configured to receive concrete therein, wherein the first and second channel members comprise opposed respective outer surfaces, wherein the first and second channel members each define a channel and a channel opening extending along the channel, wherein the opposed respective outer surfaces at least partly define the interior volume, wherein the respective channel openings of the first and second channel members face outwardly from the interior volume; and a plurality of inwardly projecting members coupled to and extending upwardly from the base wall.

2. The beam of claim 1, wherein the plurality of steel channel members are each C-shaped channel members.

3. The beam of claim 1, further comprising concrete within the interior volume.

4. The beam of claim 1, wherein the plurality of inwardly projecting members comprises a plurality of shoulder bolts that are bolted to at least one steel channel member of the plurality of steel channel members.

5. The beam of claim 1, further comprising a generally planar wall that is elongated along the longitudinal axis and attached to the bridge channel member, wherein each inwardly projecting member of the plurality of inwardly projecting members comprises:

a web section extending upwardly from the generally planar wall, the web section having a distal end; and a generally planar tab extending perpendicularly to, and from the distal end of, the web section.

6. The beam of claim 1, further comprising a plurality of straps secured to upper surfaces defined by the first and second channel members, wherein each strap of the plurality of straps extends across the interior volume.

7. The beam of claim 1, wherein the plurality of channel members comprise steel.

8. A beam having an upper surface and comprising:

a plurality of steel channel members that extend along a longitudinal axis, the plurality of steel channel members comprising:

first and second channel members spaced along a transverse axis; and a bridge channel member extending between, and coupled to, the first and second channel members, wherein the plurality of steel channel members cooperate to define an interior volume that is configured to receive concrete therein, wherein the first and second channel members comprise opposed respective outer surfaces, wherein the first and second channel members each define a channel and a channel opening extending along the channel, wherein the opposed respective outer surfaces at least partly define the interior volume, wherein the respective channel openings of the first and second channel members face outwardly from the interior volume;

a plurality of straps secured to upper surfaces defined by the first and second channel members, wherein each strap of the plurality of straps extends across the interior volume; and sing a plurality of depending internally projecting components attached to, and extending downwardly from, the plurality of straps, wherein the plurality of depending internally projecting components are positioned between and spaced from the upper surfaces of the first and second channel members.

9. The beam of claim 8, wherein the depending internally projecting components comprise a pair of parallel portions and a web extending vertically between the parallel portions.

10. The beam of claim 8, wherein the beam has a height, wherein at least one of the plurality of depending internally projecting components extends down from a respective strap of the plurality of straps by at least 15% of the height of the beam.

11. A system comprising:

a beam having an upper surface and comprising:

a plurality of steel channel members that extend along a longitudinal axis, the plurality of steel channel members comprising:

first and second channel members spaced along a transverse axis; and a bridge channel member extending between, and coupled to, the first and second channel members, wherein the bridge channel member comprises:

a base wall;

first and second side walls extending perpendicularly from the base wall; and first and second flanges respectively inwardly extending from the first and second side walls, wherein the plurality of steel channel members cooperate to define an interior volume that is configured to receive concrete therein wherein the first and second channel members comprise opposed respective outer surfaces, wherein the first and second channel members each define a channel and a channel opening extending along the channel, wherein the opposed respective outer surfaces at least partly define the interior volume, wherein the respective channel openings of the first and second channel members face outwardly from the interior volume; and a plurality of inwardly projecting members coupled to and extending upwardly from the base wall; and a column coupled to the beam.

12. The system of claim 11, wherein the column extends along a longitudinal axis, wherein the column comprises:

a third channel member having a first longitudinal end and an opposed second longitudinal end, wherein the third channel member has a length in the longitudinal dimension and defines an inner channel extending along the length of the third channel member;

a fourth channel member having a first longitudinal end and an opposed second longitudinal end, wherein the fourth channel member has a length in the longitudinal dimension and defines an inner channel extending along the length of the fourth channel member; and an inner member having a first longitudinal end and an opposed second longitudinal end, wherein the inner member has a length in the longitudinal dimension, wherein the third and fourth channel members are positioned with respect to each other so that the inner channels of the third and fourth channel members cooperate to define an interior passage extending in the longitudinal dimension, wherein the inner member extends through at least a portion of the interior passage and is attached to at least one of the first third channel member and the fourth channel member, wherein at least one of the first and second longitudinal ends of the inner member is longitudinally spaced from a respective said longitudinal end of the third channel member and a respective said longitudinal end of the second fourth channel member, wherein the length of the inner member is greater than half of the length of the first third channel member and greater than half of the length of the fourth channel member.

13. The system of claim 12, wherein the first longitudinal end of the inner member is spaced from the second longitudinal end of the third channel member by a first distance, wherein the second longitudinal end of the inner member is spaced from the second longitudinal end of the third channel member by a second distance, wherein the first distance is not equal to the second distance.

14. The system of claim 13, wherein the first distance is greater than the second distance.

15. The system of claim 12, wherein each of the third channel member and the fourth channel member is coupled to the inner member via screws.

16. The system of claim 12, wherein each of the third channel member, the fourth channel member, and the inner member comprises light gauge steel.

17. The system of claim 12, wherein each of the third channel member, the fourth channel member, and the inner member, in a cross sectional plane, have a same shape.

18. The system of claim 12, wherein the length of the first third channel member and the length of the second fourth channel member are substantially equal.

19. The system of claim 12, wherein said at least one of the first and second longitudinal ends of the inner member is longitudinally spaced from the respective longitudinal end of the third channel member and the respective longitudinal end of the fourth channel member by at least twelve inches.

* * * * *